US008870007B2

(12) United States Patent
Robbins, III et al.

(10) Patent No.: US 8,870,007 B2
(45) **Date of Patent: *Oct. 28, 2014**

(54) CUP HOLDER WITH RECESSED MOVABLE HANDLE

(71) Applicant: Edward S. Robbins, III, Muscle Shoals, AL (US)

(72) Inventors: Edward S. Robbins, III, Muscle Shoals, AL (US); Brian T. Williams, Florence, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/838,712

(22) Filed: Mar. 15, 2013

(65) Prior Publication Data

US 2014/0054305 A1 Feb. 27, 2014

Related U.S. Application Data

(63) Continuation-in-part of application No. 13/661,947, filed on Oct. 26, 2012, now Pat. No. 8,540,097, which is a continuation-in-part of application No. 13/595,739, filed on Aug. 27, 2012, now Pat. No. 8,540,096.

(51) Int. Cl.

| | |
|---|---|
| ***B65D 23/10*** | (2006.01) |
| ***A47G 23/02*** | (2006.01) |
| *B65D 25/28* | (2006.01) |

(52) U.S. Cl.

CPC ..... *A47G 23/0216* (2013.01); *B65D 23/104* (2013.01); *B65D 25/2844* (2013.01)

USPC ..... 215/396; 215/384; 220/761; 220/770

(58) Field of Classification Search

CPC ..... B65D 25/2838; B65D 25/2841; B65D 25/2844; B65D 25/2864; B65D 23/106; B65D 23/108; A47G 23/0216

USPC ..... 220/737, 761, 763, 770, 767, 772; 215/396, 384; 16/409, 410

See application file for complete search history.

(56) References Cited

U.S. PATENT DOCUMENTS

| | | | | |
|---|---|---|---|---|
| 2,005,528 A | | 6/1935 | Berchule | |
| 2,009,192 A | | 7/1935 | Freysinger | |
| 2,373,917 A | * | 4/1945 | Ross | 215/228 |
| 3,025,997 A | | 3/1962 | Matusky et al. | |
| 3,044,659 A | * | 7/1962 | Tupper | 220/760 |
| 3,073,493 A | * | 1/1963 | Pfaffenberger | 294/154 |
| 3,104,010 A | | 9/1963 | Pence | |

(Continued)

*Primary Examiner* — Mickey Yu
*Assistant Examiner* — Niki Eloshway
(74) *Attorney, Agent, or Firm* — Brinks Gilson & Lione

(57) ABSTRACT

A cup holder sidewall having a sidewall including a pair of recesses situated on opposite sides of a vertical midline, each of the recesses including at least one socket portion. A pair of handle elements adapted to be received wholly within the pair of recesses in the sidewall, each of the handle elements including at least one socket engaging portion received in the at least one socket portion of one of the recesses. The socket engaging portions being pivotable within the socket portions so as to permit the handle elements to be displaced from within the sidewall recesses to a position projecting outward from the sidewall sufficiently to permit the pair of handle elements to be grasped in one hand.

20 Claims, 27 Drawing Sheets

(56) References Cited

U.S. PATENT DOCUMENTS

| | | | | |
|---|---|---|---|---|
| 3,419,196 | A | 12/1968 | Moore | |
| 3,491,913 | A | 1/1970 | Giraudet et al. | |
| 3,581,930 | A | 6/1971 | Gunnink | |
| 3,734,336 | A | 5/1973 | Rankow et al. | |
| 3,813,003 | A * | 5/1974 | Bernazzani | 220/772 |
| 4,915,241 | A | 4/1990 | Morimura et al. | |
| 4,923,082 | A | 5/1990 | Bird | |
| 5,002,193 | A | 3/1991 | Touzani | |
| 5,647,624 | A | 7/1997 | Beshara | |
| 5,769,256 | A | 6/1998 | Medal | |
| 5,988,418 | A | 11/1999 | Maeshima | |
| 6,003,703 | A | 12/1999 | Ruggeri et al. | |
| 6,019,241 | A | 2/2000 | Burns | |
| 6,494,341 | B2 * | 12/2002 | Perkins et al. | 220/764 |
| 7,805,886 | B2 | 10/2010 | Brandstatter | |
| 8,364,542 | B2 * | 1/2013 | Grauel et al. | 705/15 |
| 2010/0213205 | A1 * | 8/2010 | Kang | 220/737 |
| 2011/0168729 | A1 | 7/2011 | Koenig et al. | |

* cited by examiner

CUP HOLDER WITH RECESSED MOVABLE HANDLE

CROSS-REFERENCE TO RELATED APPLICATION

This is a Continuation-In-Part of application Ser. No. 13/661,947 filed Oct. 26, 2012, which is in turn a Continuation-In-Part of application Ser. No. 13/595,739 filed Aug. 27, 2012, which are hereby incorporated by reference.

BACKGROUND

This invention relates to containers generally formed as integral one-piece plastic receptacles suitable for use in the distribution and consumption of milk, water, carbonated and non-carbonated beverages, other liquids and free-flowing particulates, the containers including a handle that is movable between recesses in the sidewall of the container and an extended position protruding beyond the sidewall of the container.

Containers for flowable products, such as liquids and granular products, have been formed of plastic and other materials by a variety of methods. For example, containers have been formed as an integral container body, neck finish and handle. Other containers have been formed with an integral container body and neck finish, and a separate handle later attached to the container body after completion of the container formation process. Still other containers have been formed by positioning an integral handle and a neck finish in a blow mold, whereby during blow molding of the container body (from a separate preform placed in the blow mold) the handle and the neck finish become attached to the container body. The blow molding process can include both extrusion-blow molding and injection-blow molding. Some containers have used a different plastic material for the handle than for the container body for reasons such as strength, color, aesthetics or cost. Some containers have also provided a separate handle that is attachable to the already formed container.

Little attention has been paid to considering the formation of such containers to allow for a change in the handle between a compact conformation during shipping and storage, and a more user-friendly expanded conformation during use by the end consumer. What is needed is a container having handles that can be stored in a non-extending manner and, when needed by the consumer, deployed for easy handling of the container.

SUMMARY

In one embodiment, a container can be a bottle enclosing a prescribed volume. The bottle can include a base, a sidewall extending upward from the base, a shoulder extending upward and inward from the sidewall to a finish surrounding an opening into the bottle, the finish being adapted to receive a closure. The sidewall can include a pair of recesses situated on opposite sides of a vertical midline, with at least one passage extending between the pair of recesses. The container can also include a handle having first and second portions adapted to be received wholly within the pair of recesses in the sidewall. Connecting portions can extend through the at least one passage to connect the first and second handle portions to each other. The connecting portions can include a hinge permitting the first and second portions to be displaced from within the sidewall recesses to a position projecting outward from the sidewall sufficiently to permit the first and second portions to be grasped in one hand by a user of the container.

In a preferred embodiment, at least two passages are formed between the pair of recesses so that two connecting portions join the first and second handle portions to provide enhanced strength and better control of the container during use. The first and second handle portions and connecting portion can be formed of a material that is different than that forming the bottle.

In another embodiment, a container has a bottle enclosing a prescribed volume having a sidewall including a pair of recesses situated on opposite sides of a vertical midline, each of the recesses including at least one socket portion. A pair of handles adapted to be received in the pair of recesses, each of the handle elements including at least one ball portion received in the at least one socket portion of one of the recesses, the at least one ball portions being pivotable within the at least one socket portions so as to permit the first and second portions to be displaced from within the sidewall recesses to a position projecting outward from the sidewall sufficiently to permit the first and second portions to be grasped in one hand by a user of the container.

In another embodiment, a container has a bottle enclosing a prescribed volume having a sidewall including a single recess including a vertically spaced pair of socket portion. A handle element can be adapted to be received in the pair of socket portions in the recess, with the handle element including a vertically spaced pair of ball portions received in the vertically spaced pair of socket portions, the ball portions being pivotable within the socket portions so as to permit the handle portions to be displaced from within the sidewall recesses to a position projecting outward from the sidewall sufficiently to permit the handle portion to be grasped in one hand by a user of the container.

In another embodiment, a container can be in the form of a cup designed to retain a prescribed volume, with or without a cooperating top, having a sidewall including at least one recess, each recess including at least one socket portion. At least one handle can be adapted to be received in each recess, each handle element including at least one ball portion received in the at least one socket portion of each recess, the at least one ball portions being pivotable within the at least one socket portion so as to permit each handle element to be displaced from within a sidewall recesses to a position projecting outward from the sidewall sufficiently to permit the handle portions to be grasped in one hand by a user of the container.

In another embodiment, a container can be in the form of a cup designed to retain a prescribed volume, with or without a cooperating top. A separate or integral holder for the cup can have a sidewall including at least one recess, each recess including at least one socket portion. At least one handle can be adapted to be received in each recess, each handle element including at least one socket engaging portion received in the at least one socket portion of each recess, the at least one socket engaging portions being pivotable within the at least one socket portion so as to permit each handle element to be displaced from within a sidewall recesses to a position projecting outward from the sidewall sufficiently to permit the handle portions to be grasped in one hand by a user of the container. The socket engaging portion can be in the form of a ball, a pintel, pin, rod, boss, or other similar member designed to rotate or pivot while engaged in the socket portion.

Other features of the present containers and the corresponding advantages of those features will become apparent from the following discussion of preferred embodiments, which are illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
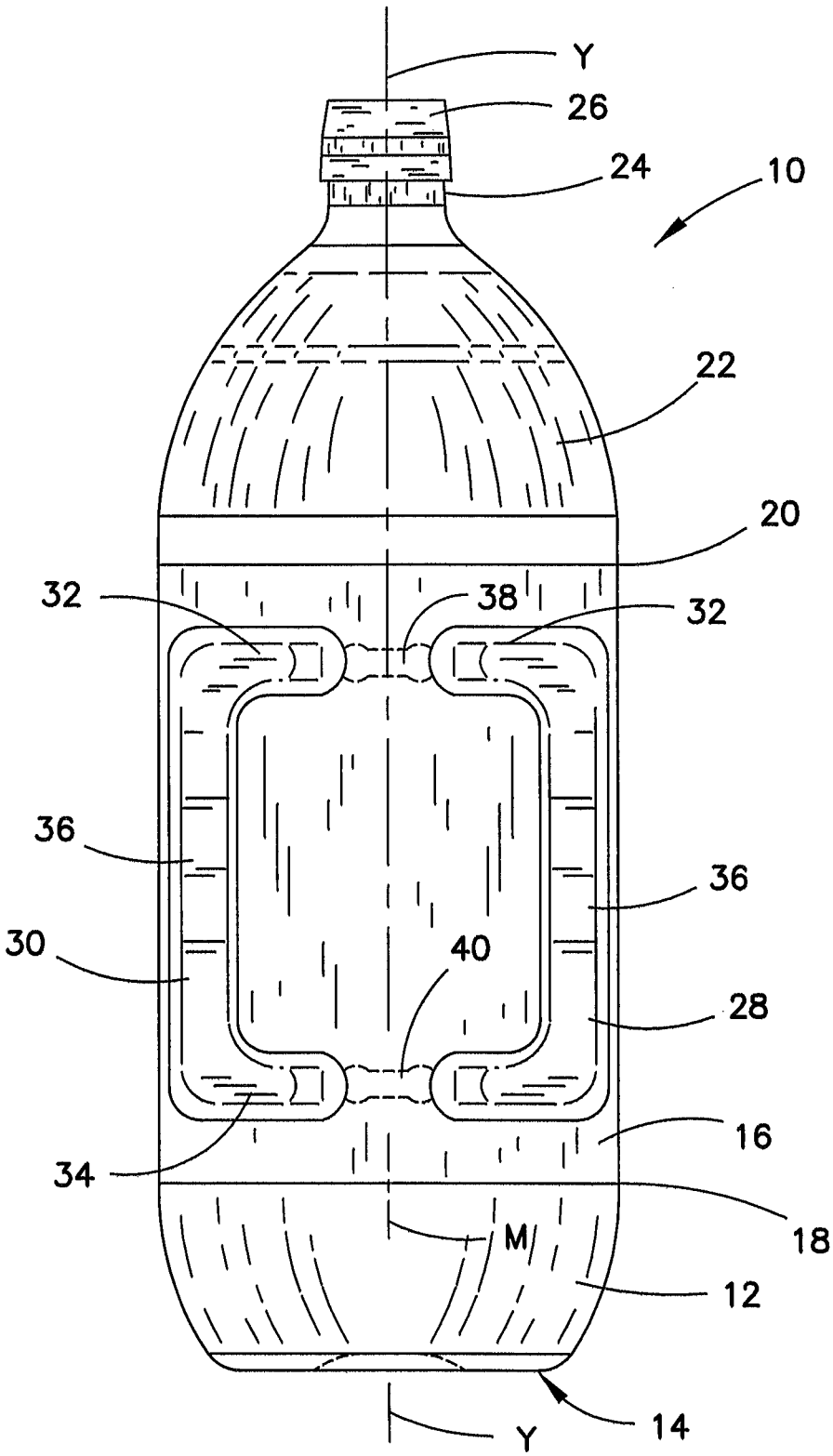
FIG. 1 is a front elevation view of a bottle including recesses adapted to receive handle portions.
Figure 2:
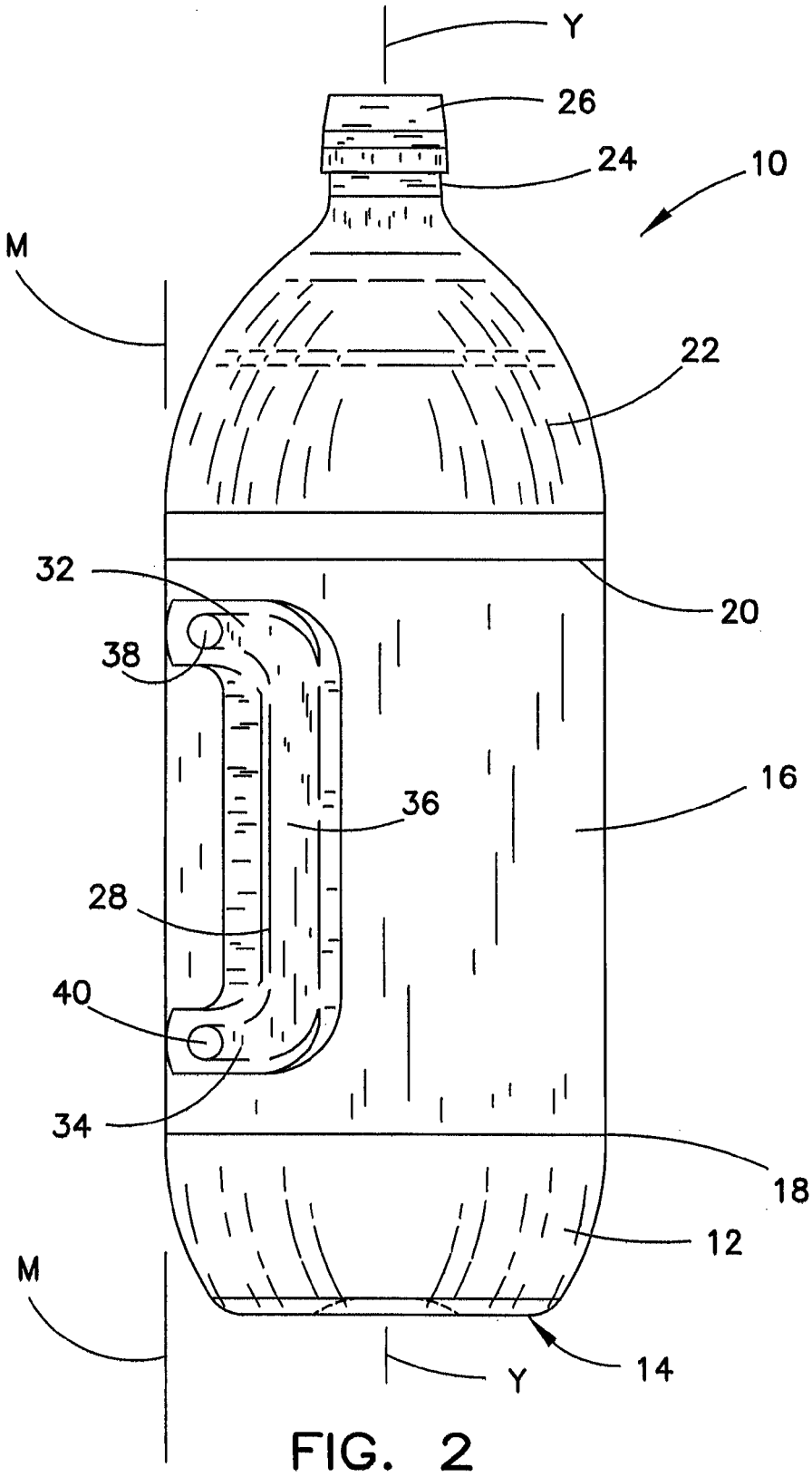
FIG. 2 is a side elevation view of the bottle of FIG. 1 showing a passage extending between the recesses.
Figure 3:
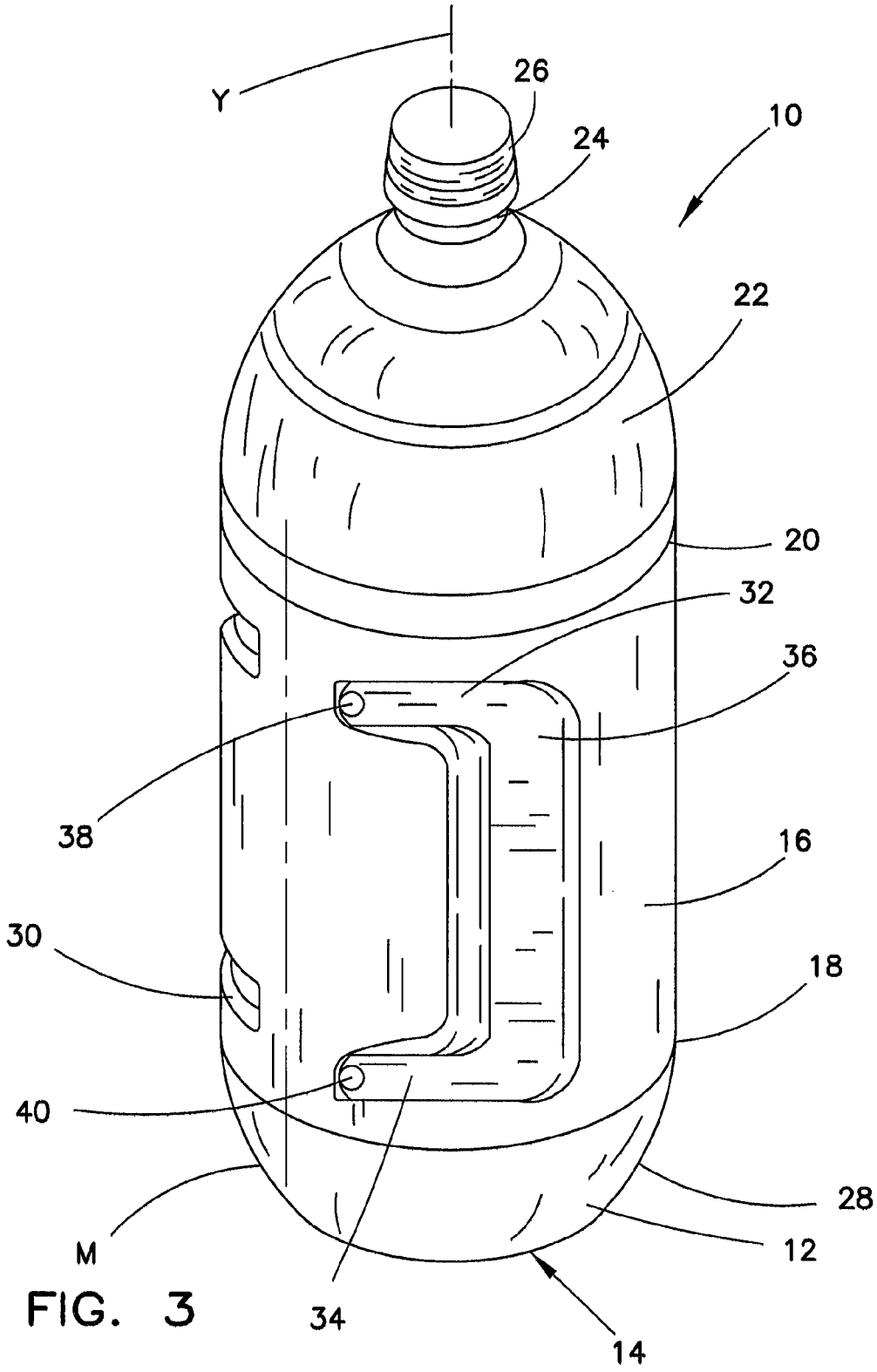
FIG. 3 is a perspective view of the bottle of FIGS. 1 and 2.

A bottle 10 is shown in FIGS. 1-3 that can be used in a container of the present invention. The bottle 10 can include a base 12. While the base 12 is illustrated to have an essentially planar bottom 14, the base 12 can be a petaloid bottom formed with a plurality of feet, or a champagne style bottom formed with a seating ring surrounding a centrally located, upwardly projected dome. A sidewall 16 can extend upward from the base 12. The sidewall 16 can include a lower margin 18 that is continuously joined to the base 12, and an upper margin 20. While the upper and lower margins 18 and 20 of sidewall 16 are shown to be circular, so that the sidewall is generally cylindrical, other shapes are also possible including triangular, ovate, rectangular, etc. A shoulder 22 can be continuously joined to the sidewall upper margin 20 to extend upward and inward from the sidewall 16 to a finish 24 surrounding an opening into the bottle 10. The finish 24 can be threaded or otherwise adapted to receive a closure 26. The bottle 10 can be formed of plastic, metal, glass and other materials.

The sidewall 16 can additionally include a pair of recesses 28, 30 situated on opposite sides of a midline M, which can be vertical and arranged parallel to an axis Y of the bottle 10. The recesses 28, 30 are shown to be indentations into the sidewall 16 including an upper leg 32, a lower leg 34 and a middle portion 36 forming a continuous trough in the sidewall 16. A passage 38 can extend between inner ends of the pair of upper legs 32 of the recesses 28, 30. Another passage 40 can extend between inner ends of the pair of lower legs 34 of the recesses 28, 30. The passages 38, 40 can be defined by inserts around which the bottle 10 is formed. The passages 38, 40 can be completely surrounded or only partially surrounded by the plastic or other material forming the sidewall 16 of the bottle 10. The volume of the bottle 10 can be selected over a range of volumes, but the utility of the container will become particularly apparent in bottles having a volume of 2 liters and greater.

Figure 4:
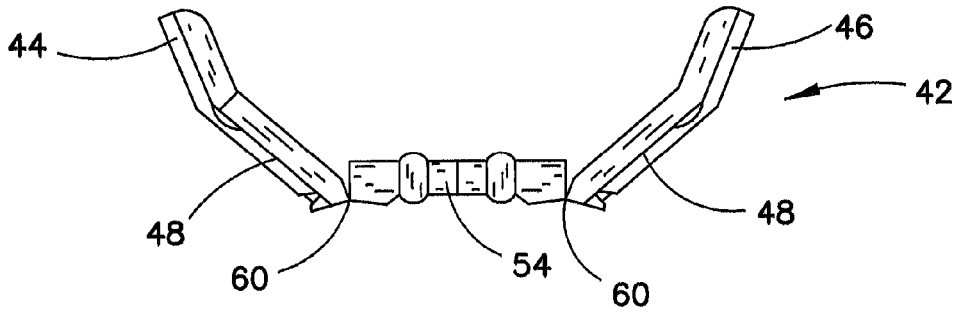
FIG. 4 is a top elevation view of a handle adapted to be coupled to the bottle of the previous FIGs.
Figure 5:
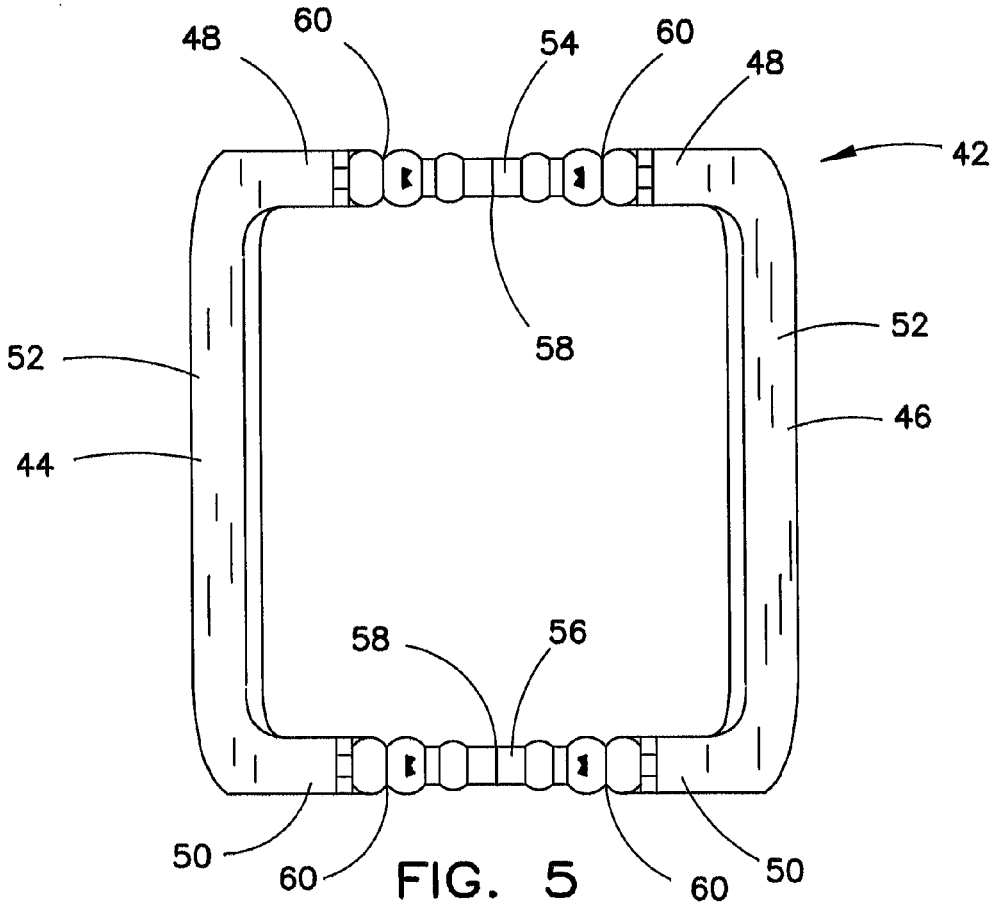
FIG. 5 is a front elevation view of a handle adapted to be coupled to the bottle of the previous FIGs.
Figure 6:
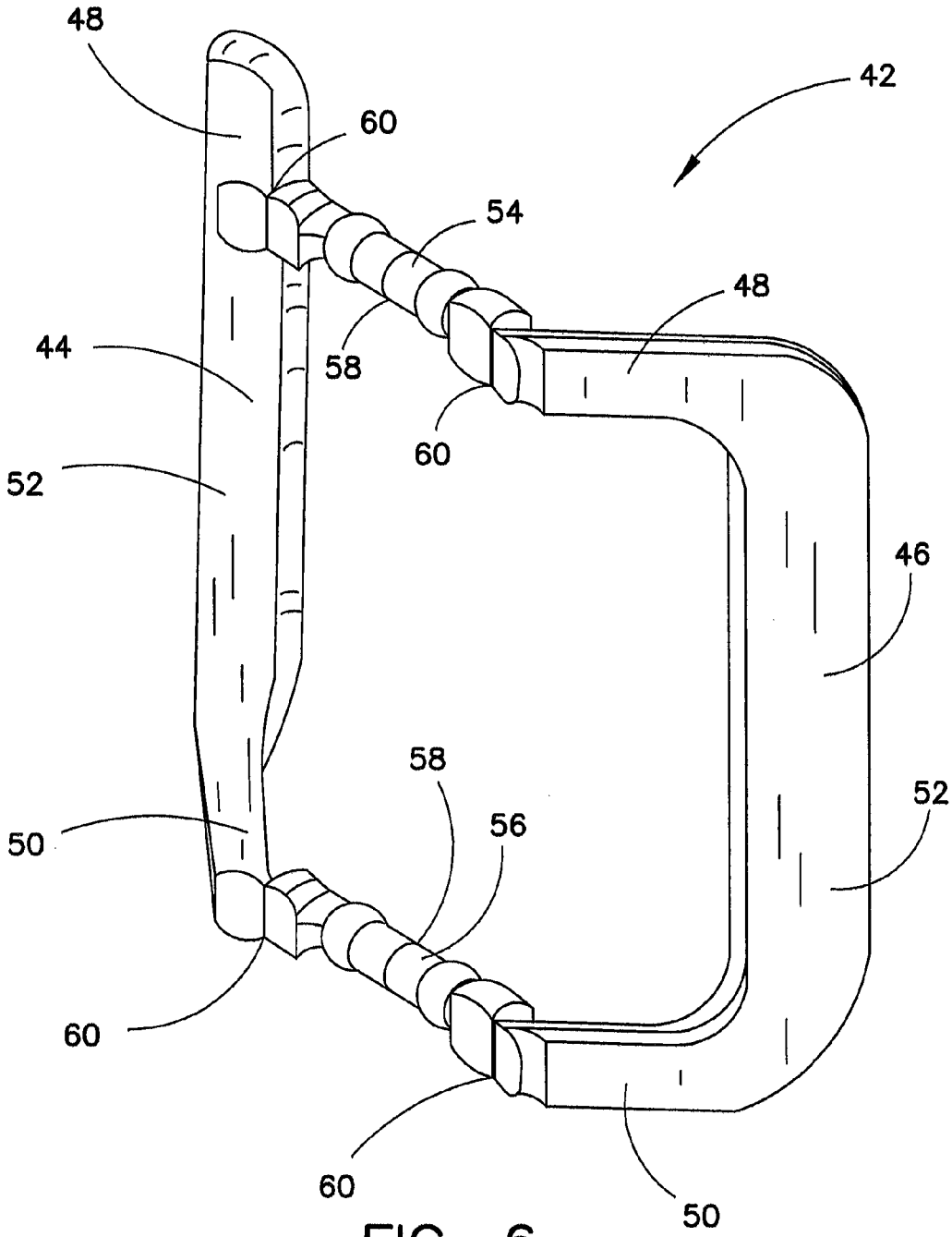
FIG. 6 is a perspective view of a handle adapted to be coupled to the bottle of the previous FIGs.
Figure 7:
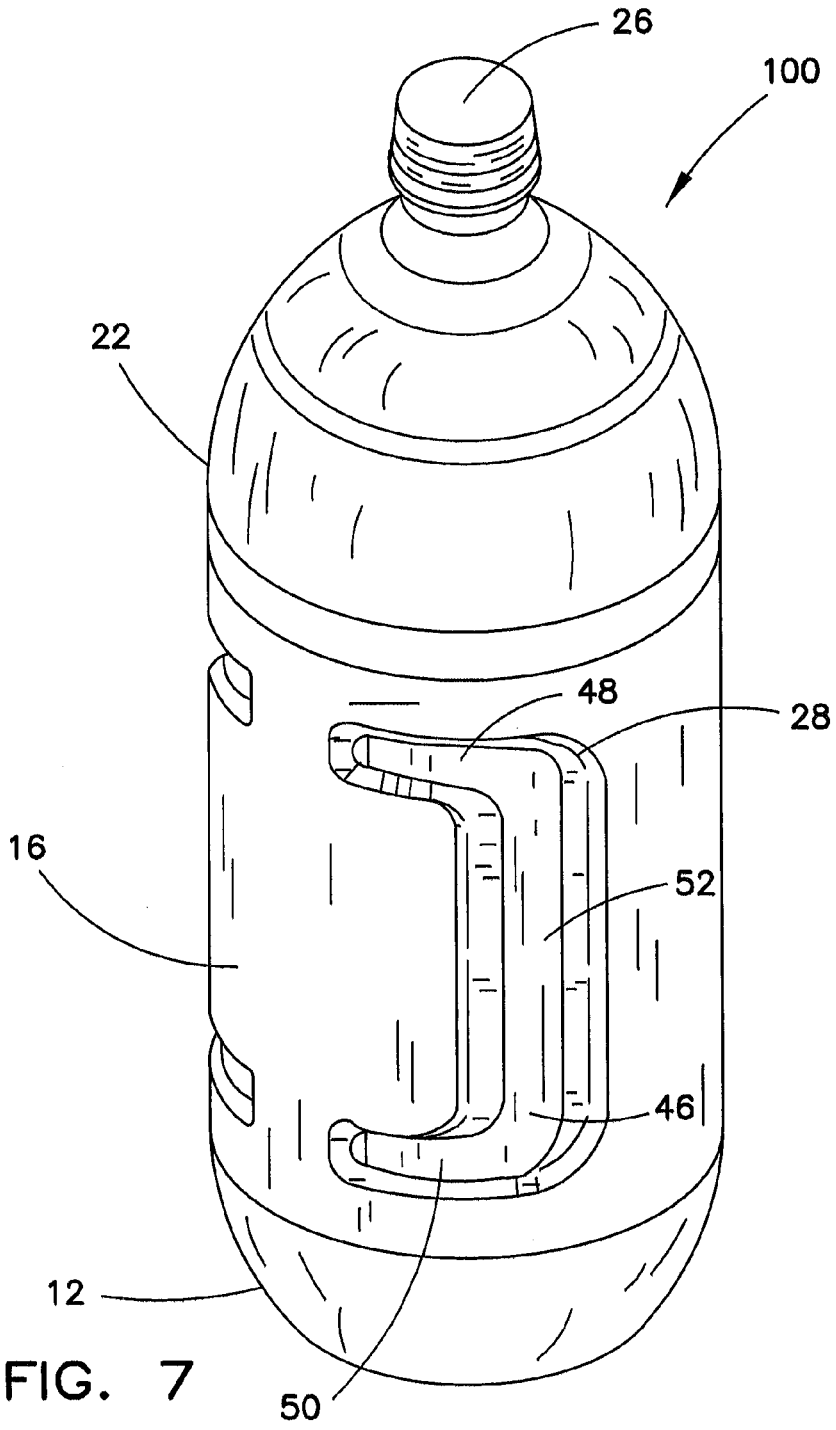
FIG. 7 is a perspective view of a container formed by the addition of the handle of FIGS. 4-6 to the bottle of FIGS. 1-3.
Figure 8:
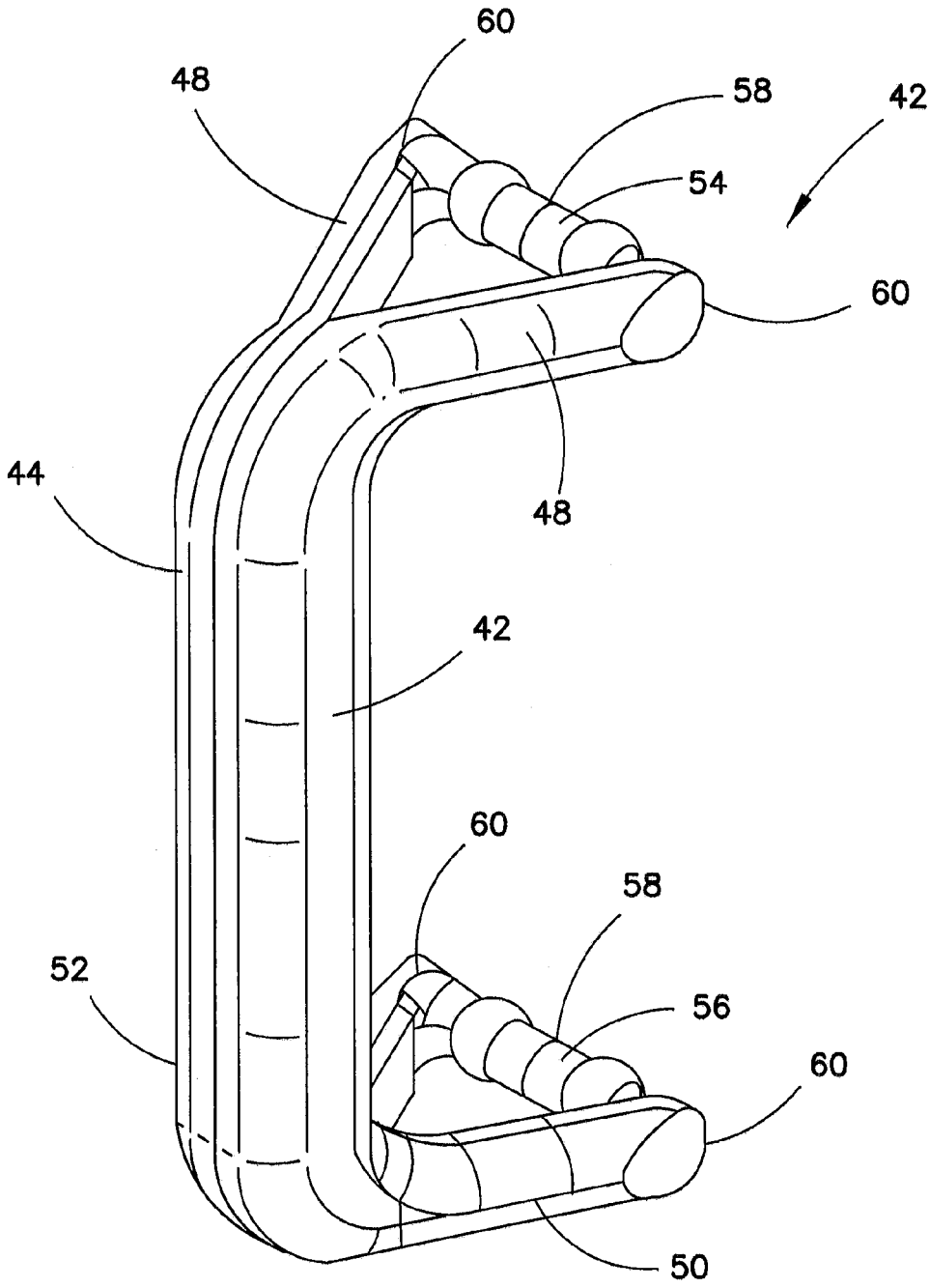
FIG. 8 is a perspective view of the handle adapted to be coupled to the bottle of the previous FIGs, the handle being folded along hinge lines to an outwardly projecting position.
Figure 9:
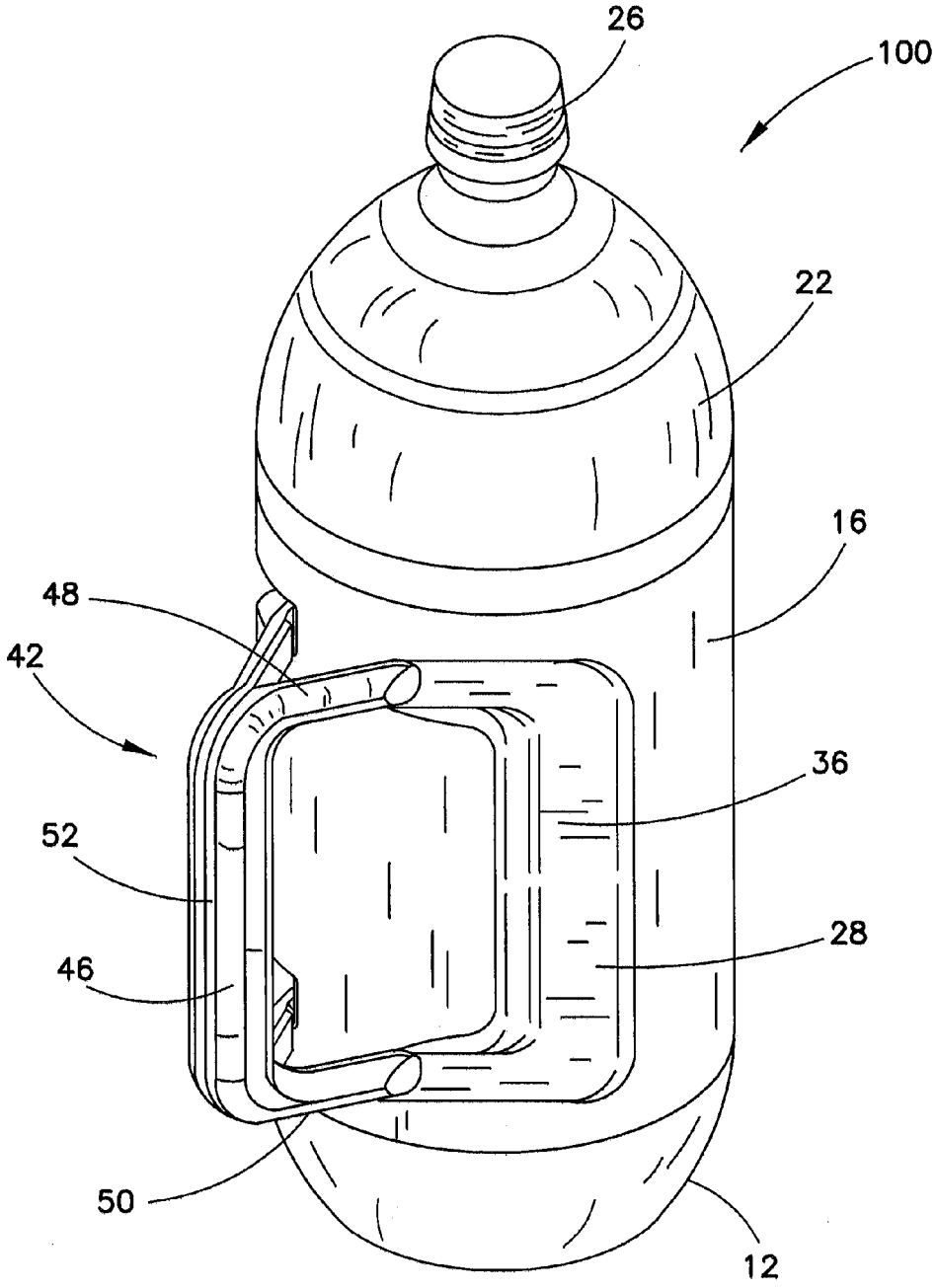
FIG. 9 is a perspective view similar to FIG. 7 with the handle folded to the outwardly projecting position.

A handle 42 is shown in FIGS. 4-6 that is suitable for use in conjunction with the bottle 10 to form a container of the present invention. The handle 42 can include a first portion 44 and second portion 46. The first and second portions 44, 46 can be suitably dimensioned to be received wholly within the pair of recesses 28, 30 in the sidewall 16 of bottle 10 as shown in FIG. 7 to form a container 100. The first and second portions 44, 46 can each include an upper portion 48, a lower portion 50, and a middle portion 52 that can join the upper and lower portions into a one-piece unitary formation. Connecting upper portions 54 can be provided to connect each of the adjoining upper portions 48. Likewise, lower connecting portions 56 can be provided to connect each of the adjoining lower portions 50. The connecting portions 54, 56 can include a separable junction 58 that will permit the connecting portions to extend through at least one of the passages 38, 40 to connect the first and second handle portions 44, 46 to each other. The connecting portions 54, 56 can include at least one hinge 60 permitting the first and second handle portions 44, 46 to be displaced from within the sidewall recesses 28, 30 of container 10, as shown in FIG. 7, to a projecting position as shown in FIGS. 8 and 9. The handle 42 is seen in FIG. 9 to project outward from the sidewall 16 sufficiently to permit the first and second portions 44, 46 to be grasped in one hand by a user of the container 10.

Figure 10:
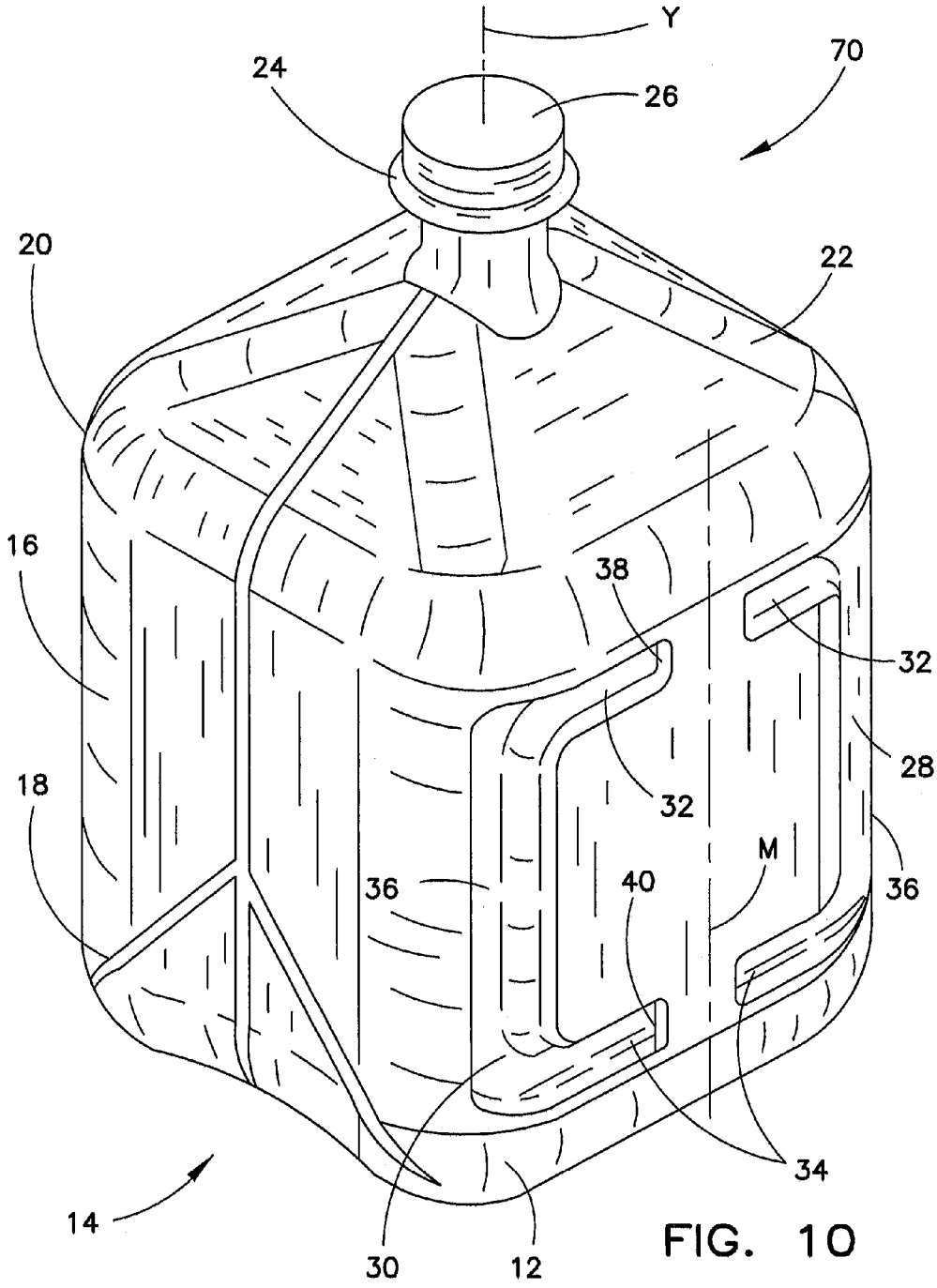
FIG. 10 is a perspective view of another bottle including recesses adapted to receive handle portions.
Figure 11:
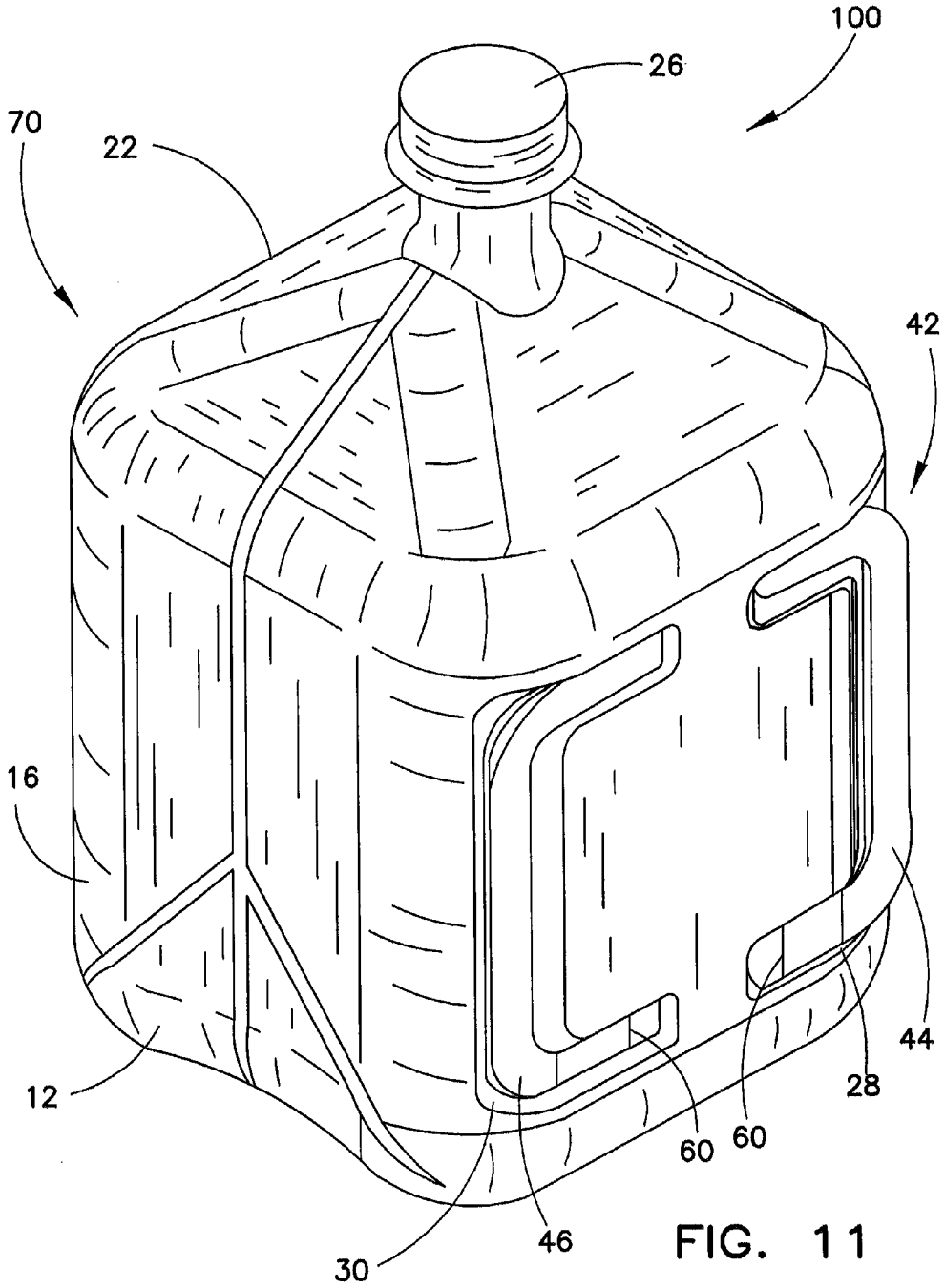
FIG. 11 is a perspective view of a container formed by the bottle of FIG. 10 and a handle similar to that shown in FIGS. 4-6.
Figure 12:
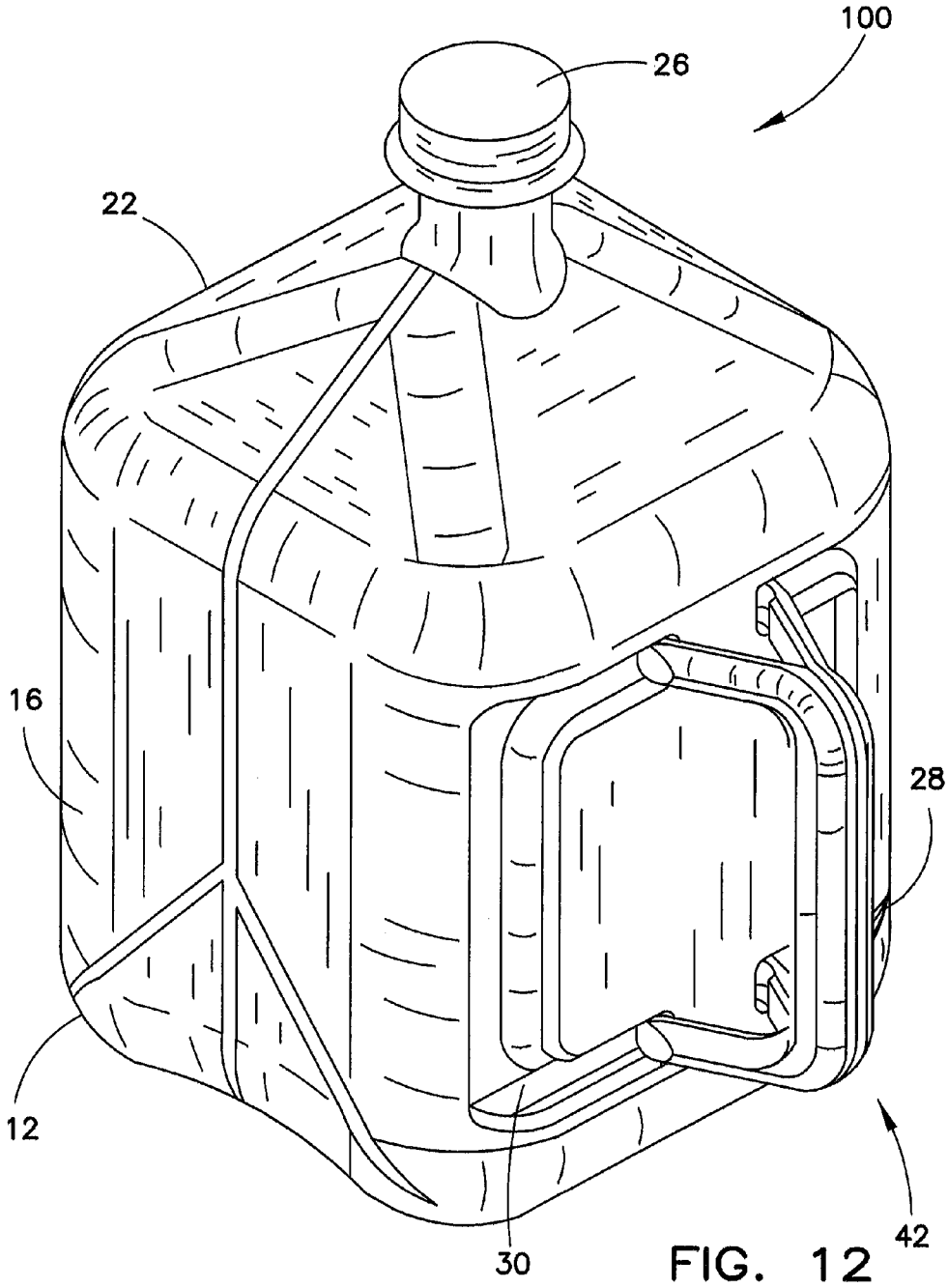
FIG. 12 is a perspective view of the container of FIG. 11 with the handle folded to the outwardly projecting position.

Another embodiment of a container 100 is shown in FIGS. 10-12, wherein the bottle 70 can include a base 12. A sidewall 16 can extend upward from the base 12. The sidewall 16 can include a lower margin 18 that is continuously joined to the base 12, and an upper margin 20. A shoulder 22 can be continuously joined to the sidewall upper margin 20 to extend upward and inward from the sidewall 16 to a finish 24 surrounding an opening into the bottle 70. The finish 24 can be threaded or otherwise adapted to receive a closure 26. The bottle 100 can be formed of plastic, metal, glass and other materials.

The sidewall 16 can additionally include a pair of recesses 28, 30 situated on opposite sides of a midline M, which can be vertical and arranged parallel to an axis Y of the bottle 70. The recesses 28, 30 are shown to be indentations into the sidewall 16 including an upper leg 32, a lower leg 34 and a middle portion 36 forming a continuous trough in the sidewall 16. A passage 38 can extend between inner ends of the pair of upper legs 32 of the recesses 28, 30. Another passage 40 can extend between inner ends of the pair of lower legs 34 of the recesses 28, 30. The passages 38, 40 can be defined by inserts around which the bottle 70 is formed. The passages 38, 40 can be completely surrounded or only partially surrounded by the plastic or other material forming the sidewall 16 of the bottle 70. When the bottle 70 is formed by an extrusion-blow molding process of polymers adapted to such processing, the passages 38, 40 between the pair of recesses 28, 30 can be formed by a pinch-mold portion that defines a seam surrounding the passage generally in alignment with the mid-line M between the recesses 28, 30.

A handle 42 similar to that shown in FIGS. 4-6 and that is suitable for use in conjunction with the bottle 70 can be used to form a container 100 as shown in FIGS. 11 and 12. The first and second portions 44, 46 of handle 42 can be suitably dimensioned to be received wholly within the pair of recesses 28, 30 in the sidewall 16 of bottle 70 as shown in FIG. 11. The handle 42 can include at least one hinge 60 permitting the first and second handle portions 44, 46 to be displaced from within the sidewall recesses 28, 30 of container 100, as shown in FIG. 11, to a projecting position as shown in FIG. 12. The handle 42 is seen in FIG. 12 to project outward from the sidewall 16 sufficiently to permit the first and second portions 44, 46 to be grasped in one hand by a user of the container 100.

Figure 13:
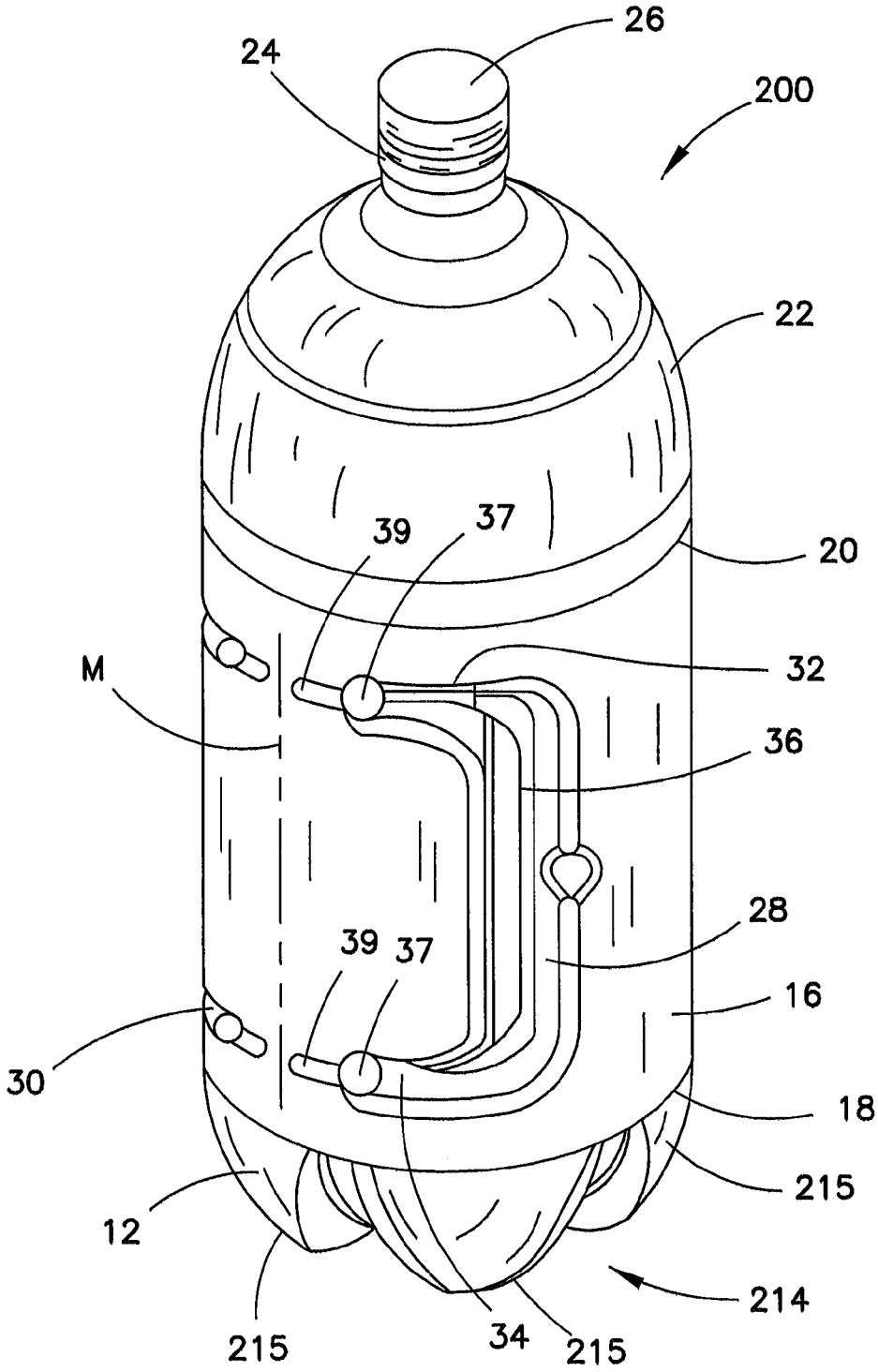
FIG. 13 is a perspective view of another bottle including recesses adapted to receive another style of handle portions.
Figure 16:
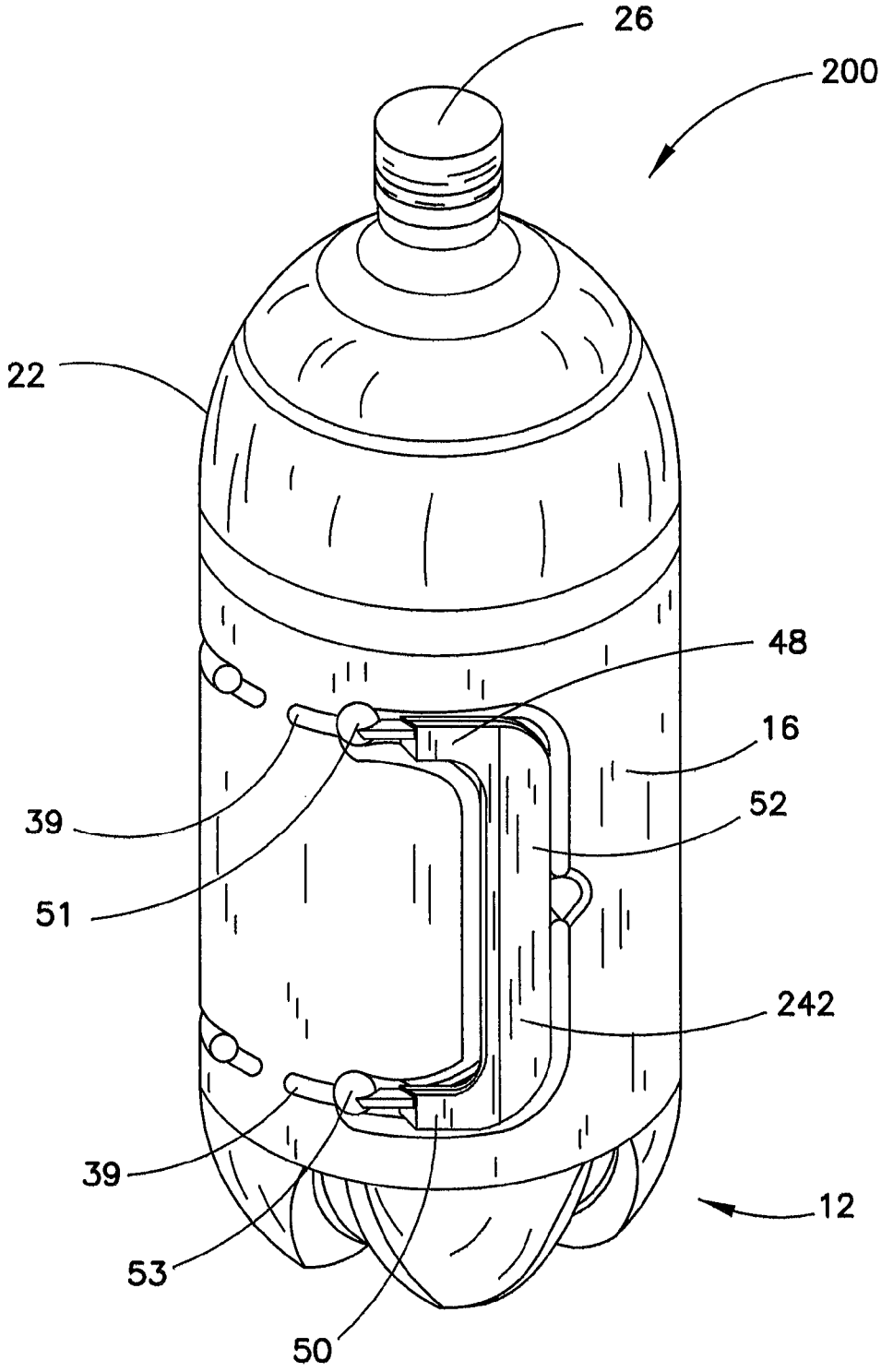
FIG. 16 is a perspective view of the bottle shown in FIG. 13 with the handles positioned within the sidewall recesses.
Figure 17:
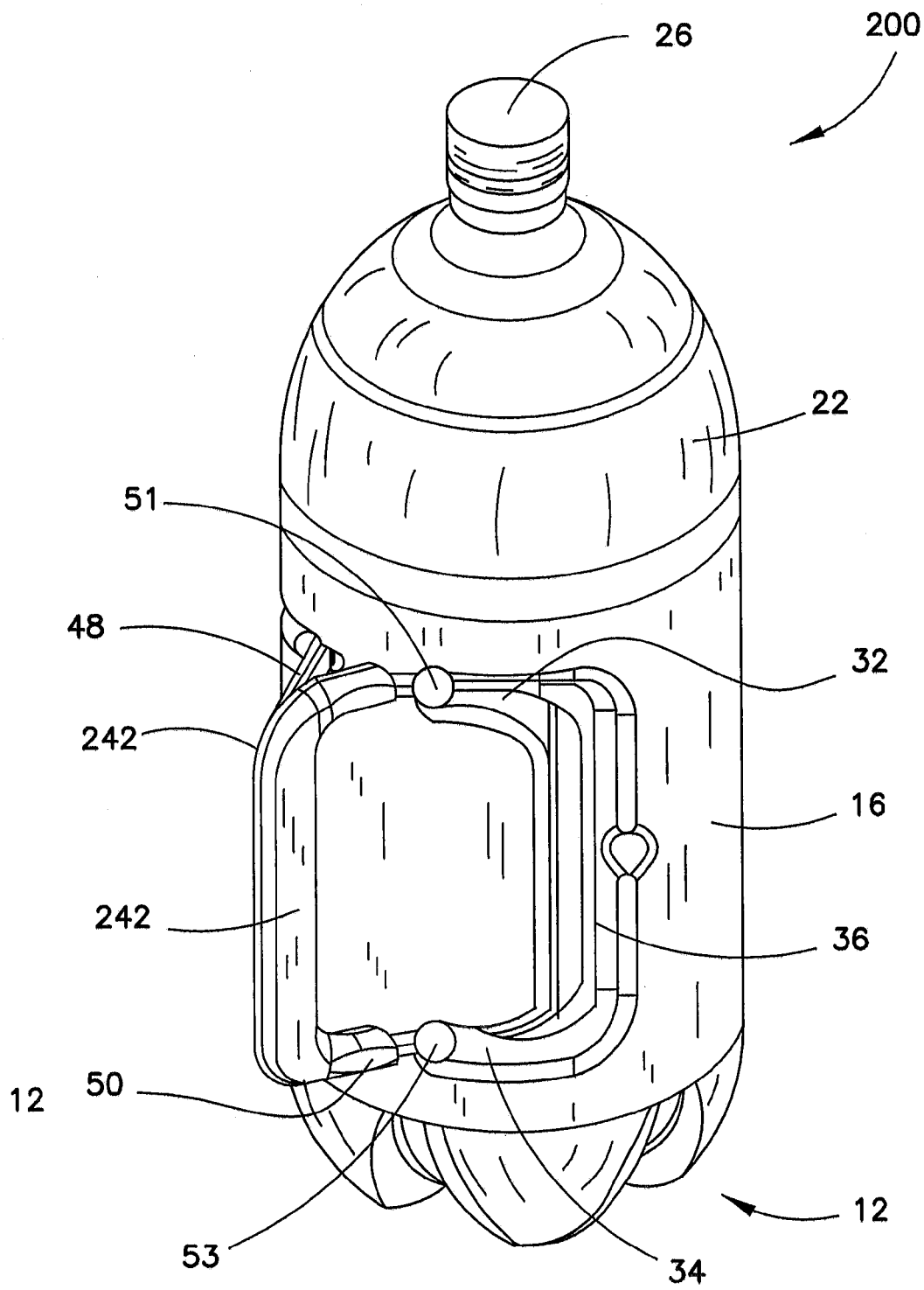
FIG. 17 is a perspective view of the bottle shown in FIG. 13 with the handles extending outward from the sidewall recesses.

Another bottle 200 is shown in FIGS. 13, 16 and 17. The bottle 200 can include a base 12. While the base 12 is illustrated to have a petaloid bottom 214 formed with a plurality of feet 215, the base 12 can be planar or a champagne style bottom formed with a seating ring surrounding a centrally located, upwardly projected dome as shown for bottle 10. A sidewall 16 can extend upward from the base 12. The sidewall 16 can include a lower margin 18 that is continuously joined to the base 12, and an upper margin 20. While the upper and lower margins 18 and 20 of sidewall 16 are shown to be circular, so that the sidewall is generally cylindrical, other shapes are also possible including triangular, ovate, rectangular, etc. A shoulder 22 can be continuously joined to the sidewall upper margin 20 to extend upward and inward from the sidewall 16 to a finish 24 surrounding an opening into the bottle 10. The finish 24 can be threaded or otherwise adapted to receive a closure 26. The bottle 200 can be formed of plastic, metal, glass and other materials.

The sidewall 16 can additionally include a pair of recesses 28, 30 situated on opposite sides of a midline M, which can be vertical and arranged parallel to an axis Y of the bottle 200. The recesses 28, 30 are shown to be indentations into the sidewall 16 including an upper leg 32, a lower leg 34 and a middle portion 36 forming a continuous trough in the sidewall 16. A socket 37 is provided at the end of the upper leg 32 and the lower leg 34 nearest to the midline M. A wedge-shaped slot 39 can extend from each of the sockets 37 toward the midline M. The volume of the bottle 200 can be selected over a range of volumes, but the utility of the container will become particularly apparent in bottles having a volume of 2 liters and greater.

Figure 14:
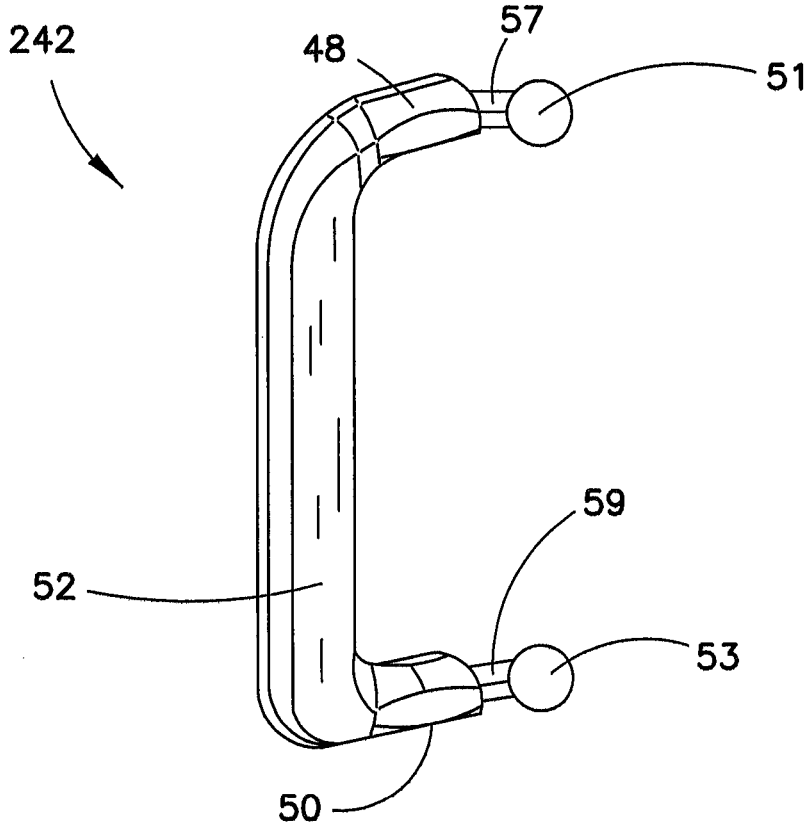
FIG. 14 is a perspective view of one of the handles adapted to be received by the bottle of FIG. 13.
Figure 15:
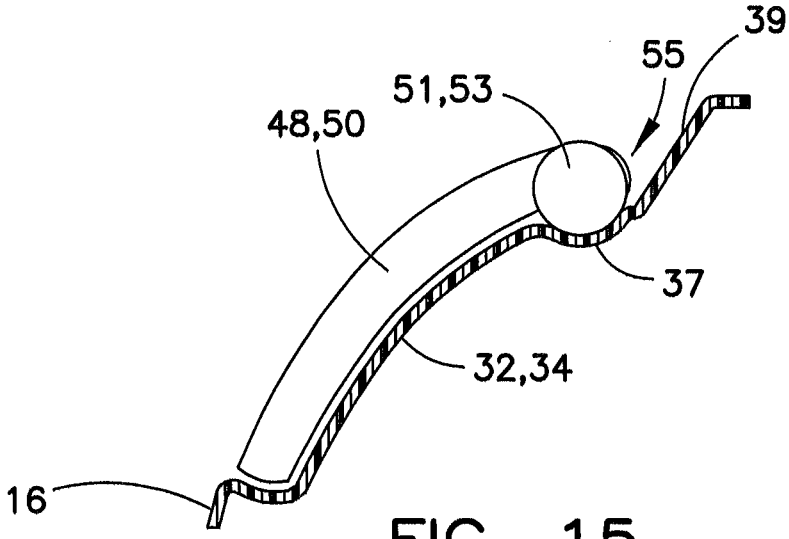
FIG. 15 is an elevation detail view of the ball portion of the handle shown in FIG. 14 in a socket adjacent the inner end of a bottle recess, shown in section.

A handle 242 is shown in FIGS. 14 and 15 that is suitable for use in conjunction with the bottle 200 to form a container of the present invention. A pair of handles 242 can be suitably dimensioned to be received wholly within the pair of recesses 28, 30 in the sidewall 16 of bottle 200. Each handle 242 can each include an upper portion 48, a lower portion 50, and a middle portion 52 that can join the upper and lower portions into a one-piece unitary formation. A ball shaped end 51 and 53 can be connected to the upper portion 48, and the lower portion 50, respectively, by web portions 57 and 59. The ball shaped ends 51 and 53 can be received in the sockets 37 at the inner ends of sidewall recesses 28 and 30 so that the handles 242 can be wholly received within the recesses 28, 30 as shown in FIG. 16. The ball shaped ends 51 and 53 permit the handles to be displaced from the recessed position shown in FIG. 16 to a projecting position as shown in FIG. 17. This displacement causes the web portions 57 and 59 to enter into slots 39 so that the middle portions 52 of the handles 242 are sufficiently close to each other to permit the handles 242 to be grasped in one hand by a user of the container 200.

The ball shaped ends 51 and 53 can be spherical, but at least one of the ball shaped ends 51 and 53 can be non-spherical so as to include a projecting portion 55 as shown in FIG. 15. The projecting portion 55 can interact with the adjacent socket 37 so as to provide a detent biasing the handles 242 toward either a fully retained or a fully projecting position. This biasing of the handles toward the fully retained position acts to inhibit accidental projection of the handles 242 during transport of the bottles 200. The biasing of the handles toward the fully projecting position acts to ensure that the middle portions 52 of the handles 242 are sufficiently close to each other to permit the handles 242 to be grasped in one hand by a user of the container 200.

Figure 18:
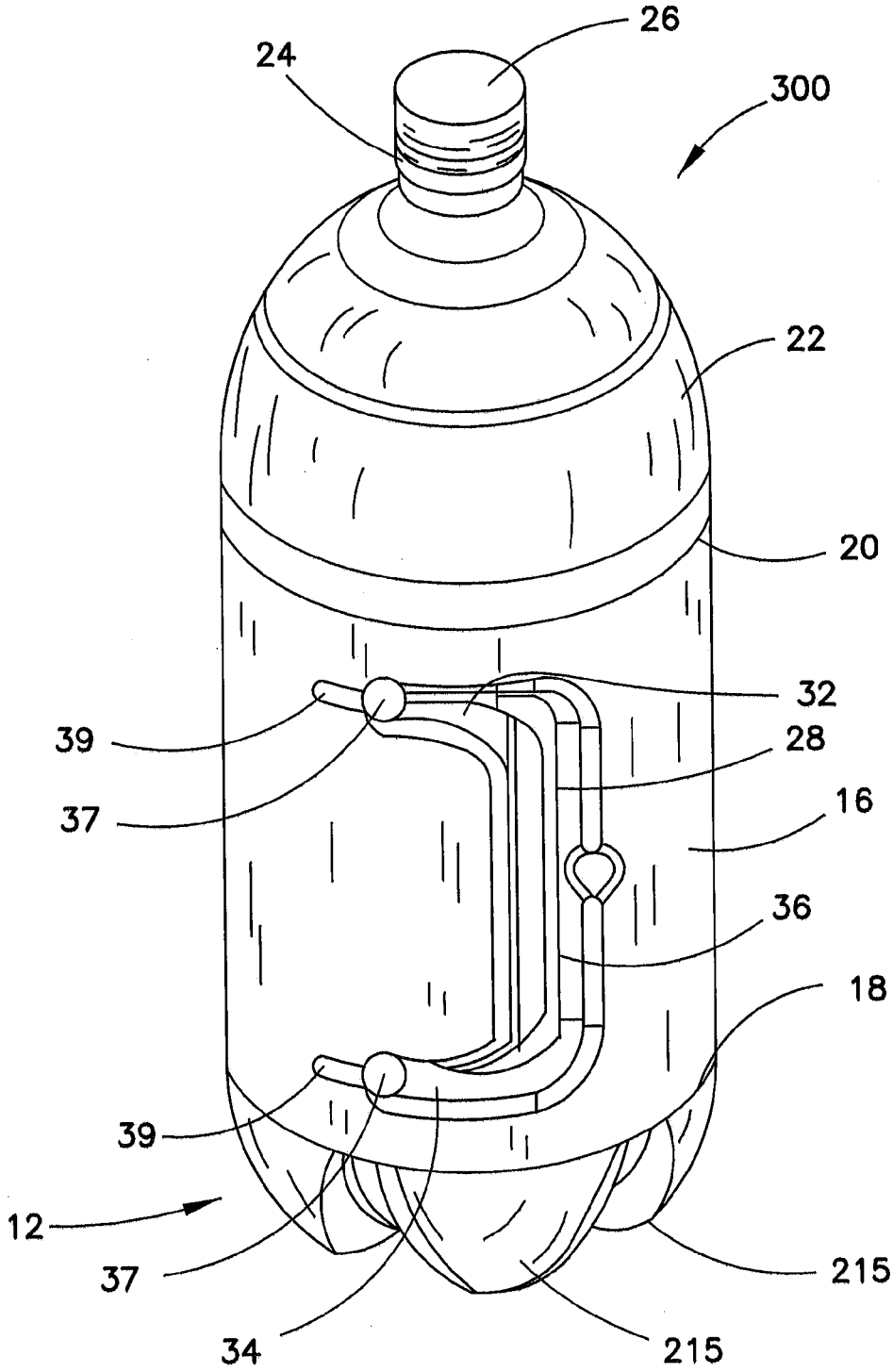
FIG. 18 is a perspective view of a bottle similar to FIG. 13, but having only a single recess to receive a handle generally of the type shown in FIGS. 14 and 15.
Figure 19:
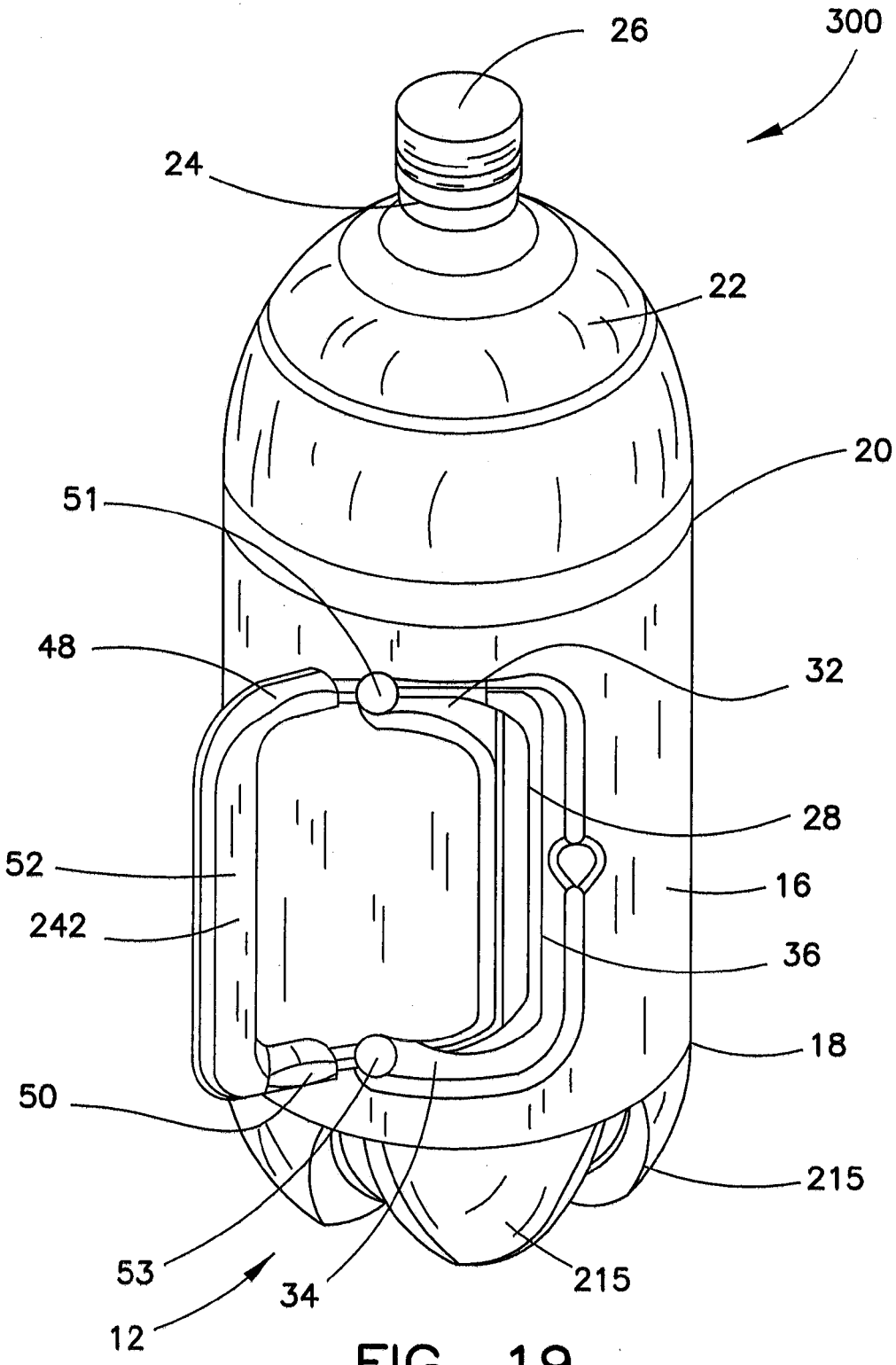
FIG. 19 is a perspective view of the bottle shown in FIG. 18 with the handle extending outward from the sidewall recess.

While FIGS. 13, 16 and 17 depict a container 200 having a pair of handles 242, it may be appropriate in certain circumstances to employ a container 300 having only a single handle 242 received in a single slot 36 as shown in FIGS. 18 and 19. The bottle 300 can include a base 12, illustrated to have a petaloid bottom 214 formed with a plurality of feet 215. A sidewall 16 can extend upward from the base 12. The sidewall 16 can include a lower margin 18 that is continuously joined to the base 12, and an upper margin 20. While the upper and lower margins 18 and 20 of sidewall 16 are shown to be circular, so that the sidewall is generally cylindrical, other shapes are also possible including triangular, ovate, rectangular, etc. A shoulder 22 can be continuously joined to the sidewall upper margin 20 to extend upward and inward from the sidewall 16 to a finish 24 surrounding an opening into the bottle 10. The finish 24 can be threaded or otherwise adapted to receive a closure 26. The bottle 300 can be formed of plastic, metal, glass and other materials.

The sidewall 16 of bottle 300 is shown to include only a single recess 28. The recess 28 takes the form of an indentation into the sidewall 16 including an upper leg 32, a lower leg 34 and a middle portion 36 forming a continuous trough in the sidewall 16. A socket 37 is provided at the end of the upper leg 32 and the lower leg 34. A wedge-shaped slot 39 can extend laterally from each of the sockets 37 opposite the upper and lower leg portions 32, 34. The volume of the bottle 300 can be selected over a range of volumes, but the utility of the container will become particularly apparent in bottles having a volume of 1 liter to 2 liters.

The handle 242 shown in FIGS. 14 and 15 is suitable for use in conjunction with the bottle 300 to form a container of the present invention. The handle 242 can be suitably dimensioned to be received wholly within the single recess 28 in the sidewall 16 of bottle 300. The handle 242 can include an upper portion 48, a lower portion 50, and a middle portion 52 that can join the upper and lower portions into a one-piece unitary formation. A ball shaped end 51 and 53 can be connected to the upper portion 48, and the lower portion 50, respectively, by web portions 57 and 59. The ball shaped ends 51 and 53 can be received in the sockets 37 in the sidewall recess 28 shown in FIG. 18 so that the handle 242 can be wholly received within the recess 28. The ball shaped ends 51 and 53 permit the handle 242 to be displaced from the recessed position to a projecting position as shown in FIG. 19. This displacement causes the web portions 57 and 59 to enter into slots 39 so that the middle portion 52 of the handle 242 can grasped in one hand by a user of the container 300.

Figure 20:
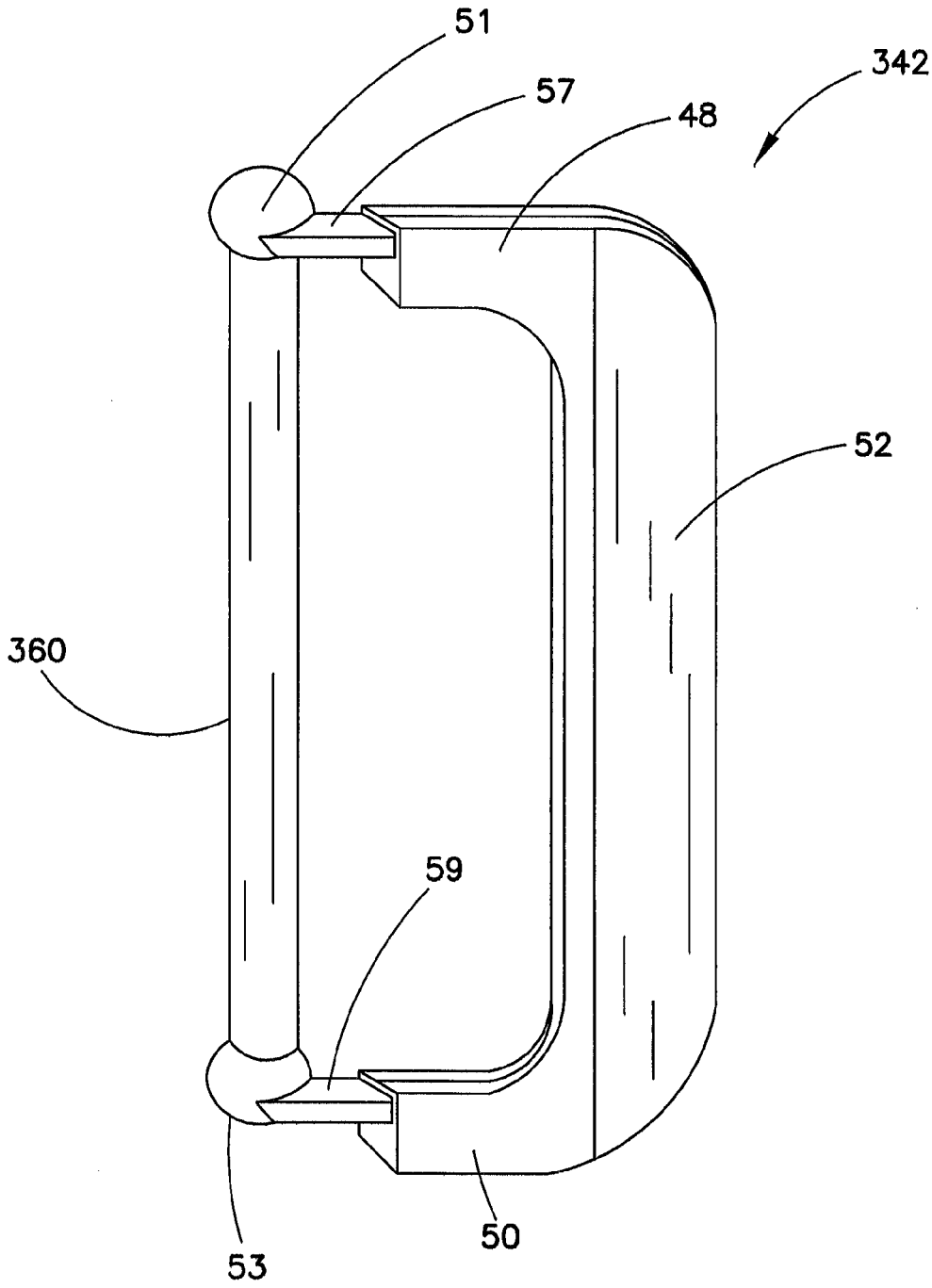
FIG. 20 is a perspective view of an alternative handle.
Figure 21:
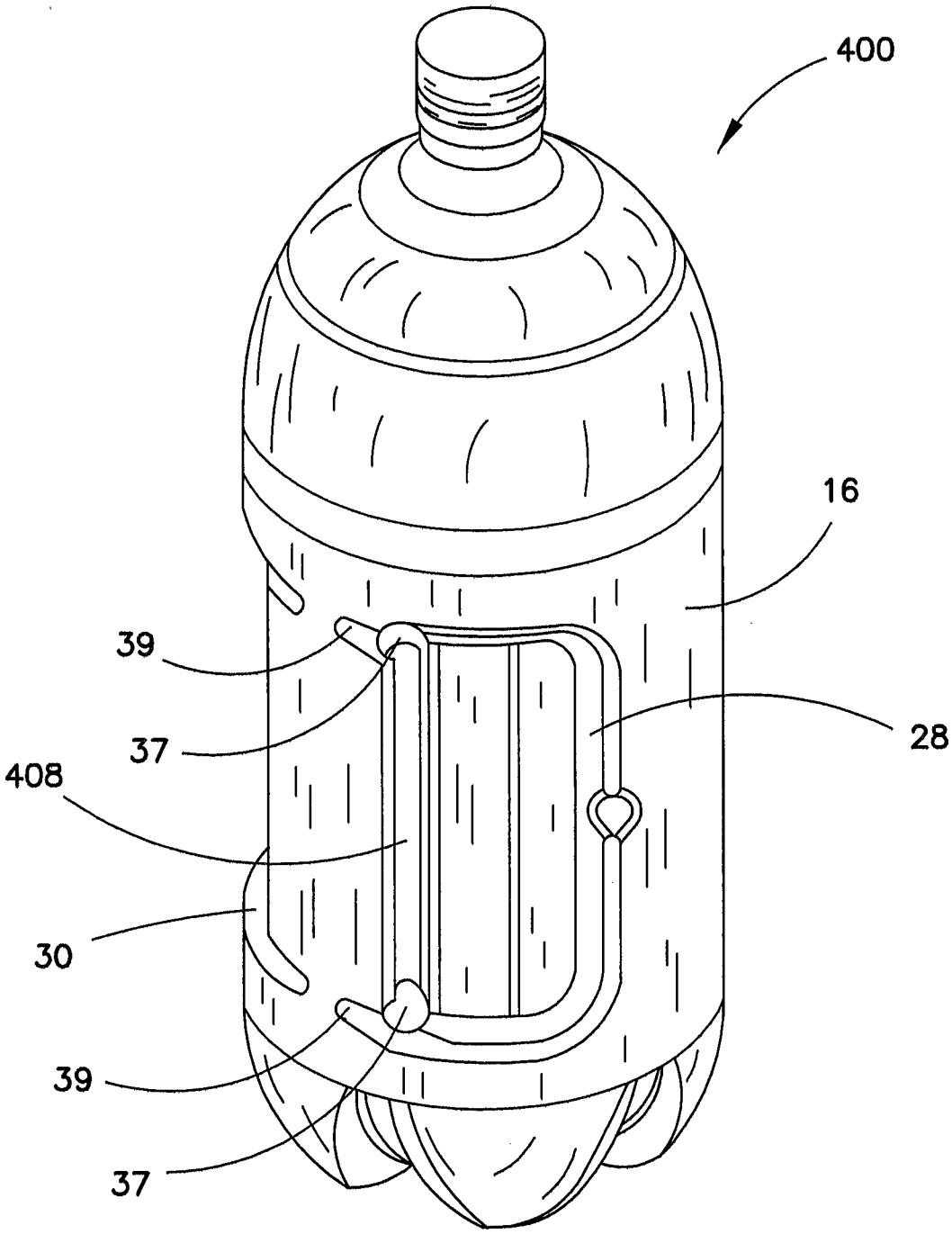
FIG. 21 is a perspective view of another bottle including recesses adapted to receive the handle shown in FIG. 20.
Figure 22:
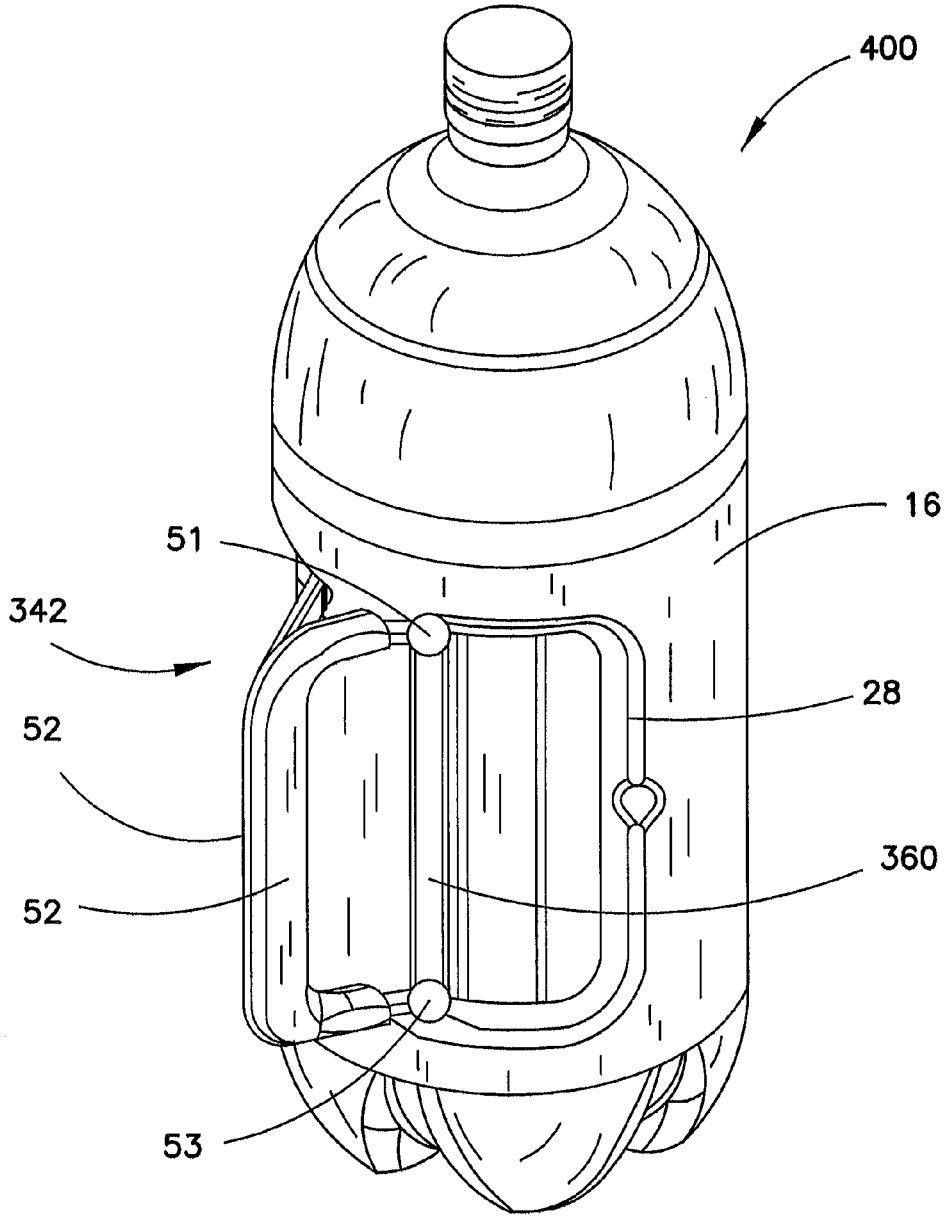
FIG. 22 is a perspective view of the bottle shown in FIG. 21 with the handles extending outward from the sidewall recesses.

Another alternative handle 342 is shown in FIG. 20. The handle 342 shown in FIG. 20 is suitable for use in conjunction with a bottle 400 shown in FIGS. 21 and 22 to form a container of the present invention. The bottle 400 can be formed of plastic, metal, glass and other materials. A pair of handles 342 can be suitably dimensioned to be received wholly within the pair of recesses 28, 30 in the sidewall 16 of bottle 400. Each handle 342 can each include an upper portion 48, a lower portion 50, and a middle portion 52 that can join the upper and lower portions into a one-piece unitary formation. A ball shaped end 51 and 53 can be connected to the upper portion 48, and the lower portion 50, respectively, by web portions 57 and 59. A pintle member 360 can extend vertically between the ball shaped ends 51 and 53. The ball shaped ends 51 and 53 can be received in the sockets 37 at the inner ends of sidewall recesses 28 and 30. The pintle member 360 can be received in vertical slots 408 in the sidewall 16 of bottle 400 so that the handles 342 can be wholly received within the recesses 28, 30. The ball shaped ends 51 and 53 permit the handles to be displaced from the recessed position to a projecting position as shown in FIG. 22. This displacement causes the web portions 57 and 59 to enter into slots 39 so that the middle portions 52 of the handles 342 are sufficiently close to each other to permit the handles 342 to be grasped in one hand by a user of the container 400.

The ball shaped ends 51 and 53 of handles 342 can be spherical, but at least one of the ball shaped ends 51 and 53 can be non-spherical so as to include a projecting portion 55 as shown in FIG. 15. The projecting portion 55 can interact with the adjacent socket 37 so as to provide a detent biasing the handles 342 toward either a fully retained or a fully projecting position. This biasing of the handles toward the fully retained position acts to inhibit accidental projection of the handles 342 during transport of the bottles 400. The biasing of the handles toward the fully projecting position acts to ensure that the middle portions 52 of the handles 342 are sufficiently close to each other to permit the handles 342 to be grasped in one hand by a user of the container 400.

Figure 23:
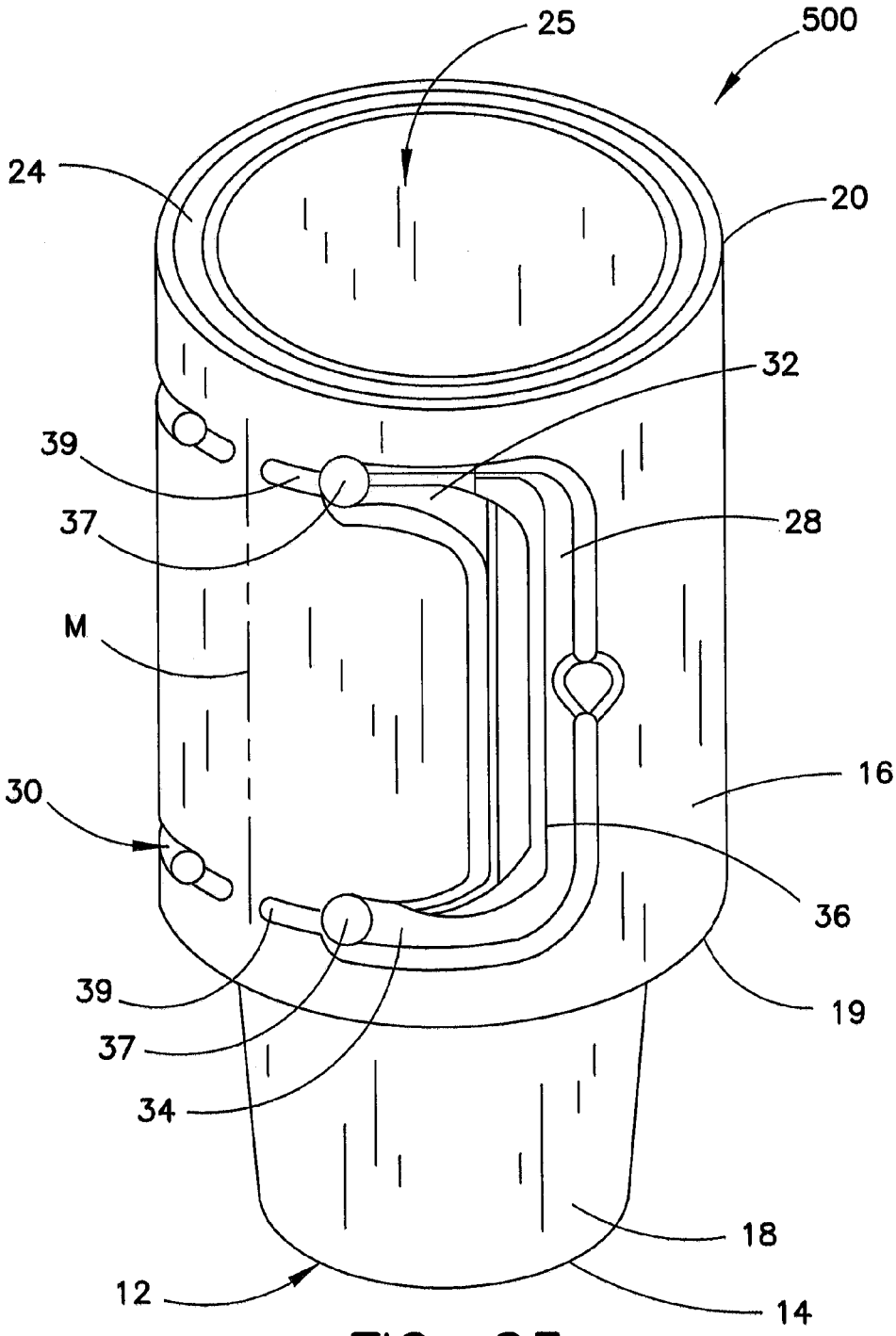
FIG. 23 is a perspective view a mug, cup holder, or similar article including recesses adapted to receive the handle shown in FIGS. 14 and 15.
Figure 24:
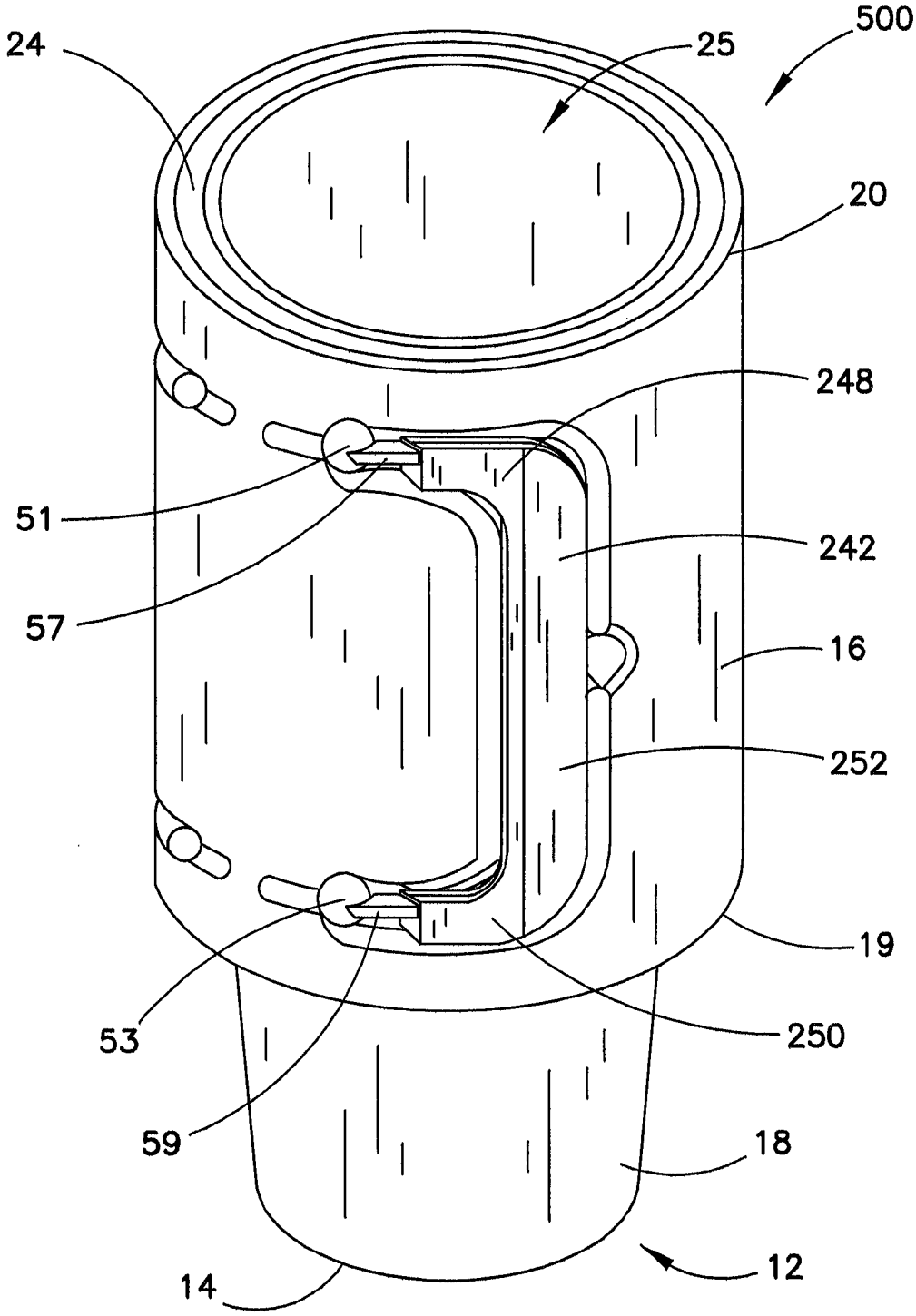
FIG. 24 is a perspective view of the mug, cup holder, or similar article of FIG. 23 with the handles shown received in the sidewall recesses.
Figure 25:
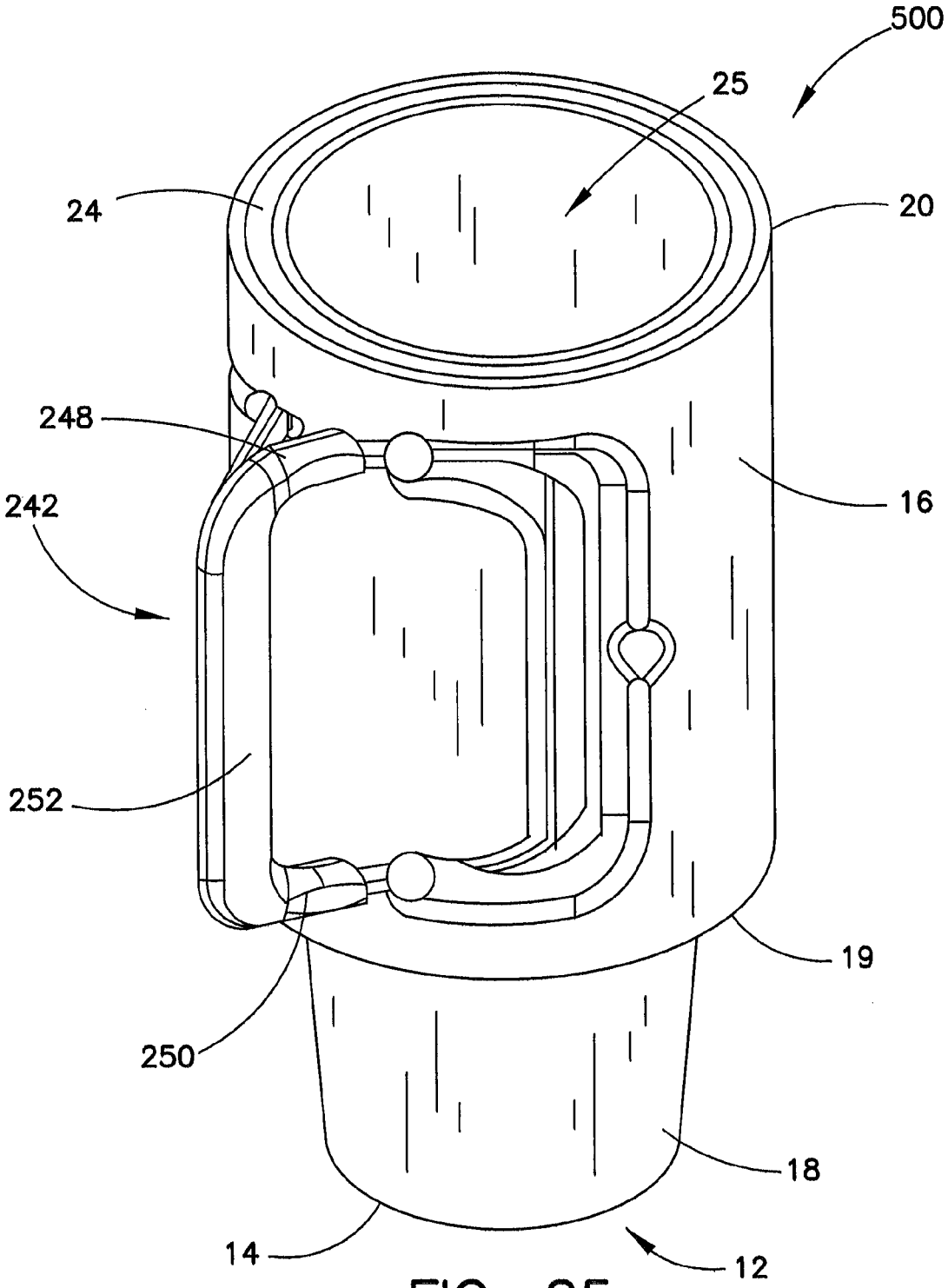
FIG. 25 is a perspective view of the mug, cup holder, or similar article of FIG. 23 with the handles shown protruding from the sidewall recesses.

The handle 242 shown in FIGS. 14 and 15 can also be used in conjunction with the container 500 shown in FIGS. 23-25. The container 500 is seen to have the general shape of a coffee mug or similar article including a base 12 having an essentially planar bottom 14. The container 500 can be formed of plastic, metal, glass and other materials. An outer sidewall 16 can extend upward from the base 12. The outer sidewall 16 can include a lower margin 18 that is continuously joined to the base 12, and an upper margin 20. While the upper and lower margins 18 and 20 of outer sidewall 16 are shown to be circular, so that the sidewall is generally cylindrical, other shapes are also possible. A step 19 can be provided between the upper and lower margins 18 and 20 to further define the outer sidewall 16 into a smaller lower diameter and a larger upper diameter. A finish 24 can be continuously joined to the sidewall upper margin 20 to surround an opening 25 into the container 500. An interior or exterior surface of the finish 24 can be threaded or otherwise adapted to receive a closure, not shown. The sidewall can be made of a single layer of material or multiple layers of material to enhance the thermal retention properties of the container 500, thus forming a thermos-like article. When formed of multiple layers of material, an innermost layer can omit some or all of the features found in the outer sidewall 16.

The outer sidewall 16 can additionally include a pair of recesses 28, 30 situated on opposite sides of a midline M, which can be vertical and arranged parallel to an axis Y of the container 500. The recesses 28, 30 are shown to be indentations into larger diameter portions of the outer sidewall 16 including an upper leg 32, a lower leg 34 and a middle portion 36 forming a continuous trough in the outer sidewall 16. A socket 37 is provided at the end of the upper leg 32 and the lower leg 34 nearest to the midline M. A wedge-shaped slot 39 can extend from each of the sockets 37 toward the midline M.

The handles 242 can be suitably dimensioned to be received wholly within the pair of recesses 28, 30 in the outer sidewall 16 of container 500. Each handle 242 can each include an upper portion 248, a lower portion 250, and a middle portion 252 that can join the upper and lower portions into a one-piece unitary formation. A ball shaped end 51 and 53 can be connected to the upper portion 48, and the lower portion 50, respectively, by web portions 57 and 59. The ball shaped ends 51 and 53 can be received in the sockets 37 at the inner ends of sidewall recesses 28 and 30 so that the handles 242 can be wholly received within the recesses 28, 30 as shown in FIG. 24. The ball shaped ends 51 and 53 permit the handles to be displaced from the recessed position shown in FIG. 24 to a projecting position as shown in FIG. 25. This displacement causes the web portions 57 and 59 to enter into slots 39 so that the middle portions 252 of the handles 242 are sufficiently close to each other to permit the handles 242 to be grasped in one hand by a user of the container 500.

Figure 26:
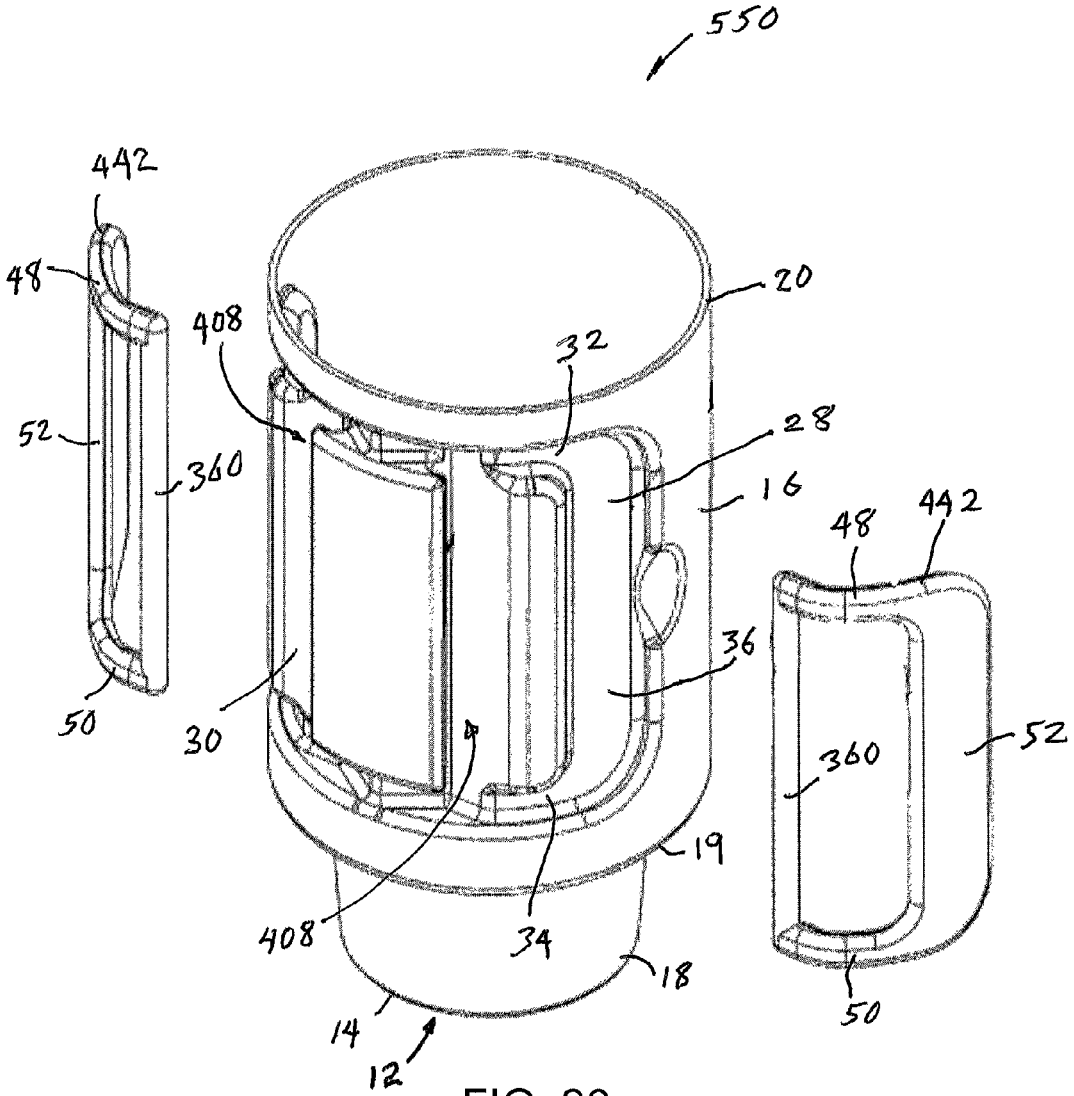
FIG. 26 is an exploded perspective view of a cup holder having two handles with rod portions receivable in vertical linear recesses.

Cup or cup holder 550 is shown in FIG. 26 to have a base 12 having an essentially planar bottom 14. An outer sidewall 16 can extend upward from the base 12. An outer sidewall 16 can include a lower margin 18 that is continuously joined to the base 12, and an upper margin 20. While the upper and lower margins 18 and 20 of outer sidewall 16 are shown to be circular, so that the sidewall is generally cylindrical, other shapes are also possible. A step 19 can be provided between the upper and lower margins 18 and 20 to further define the outer sidewall 16 into a smaller lower diameter and a larger upper diameter. The cup or cup holder 550 can itself receive liquids or receive a separate cup, not shown, which may or may not be disposable. The sidewall 16 can be made of a single layer of material or multiple layers of material to enhance the thermal retention properties of the cup or cup holder 550. The cup or cup holder 550 can be formed of plastic, metal, and other materials.

Handles 442, shown in FIG. 26, are similar to handle 342 shown in FIG. 20, and are suitable for use in conjunction with the cup or cup holder 550. The sidewall 16 of cup or cup holder 550 can include a pair of recesses 28, 30 situated on opposite sides of a midline M, which can be vertical and arranged parallel to an axis Y of the cup or cup holder 550. The recesses 28, 30 are shown to be indentations into the sidewall 16 including an upper leg 32, a lower leg 34 and a middle portion 36 forming a continuous trough in the sidewall 16. The pair of handles 442 can be suitably dimensioned to be received wholly within the pair of recesses 28, 30 in the sidewall 16 of cup or cup holder 550. Each handle 442 can each include an upper portion 48, a lower portion 50, and a middle portion 52 that can join the upper and lower portions into a one-piece unitary formation. A pintle member 360 can extend vertically between the upper portion 48 and lower portion 50 opposite the middle portion 52. The pintle member 360 can be received in vertical slots 408 in the sidewall 16 of cup or cup holder 550 so that the handles 442 can be wholly received within the recesses 28, 30. The pintle members 360 can be rotated in the vertical slots 408 to permit the handles to be displaced from a recessed position to a projecting position so that the middle portions 52 of the handles 442 are sufficiently close to each other to permit the handles 442 to be grasped in one hand by a user of the cup or cup holder 550.

Figure 27:
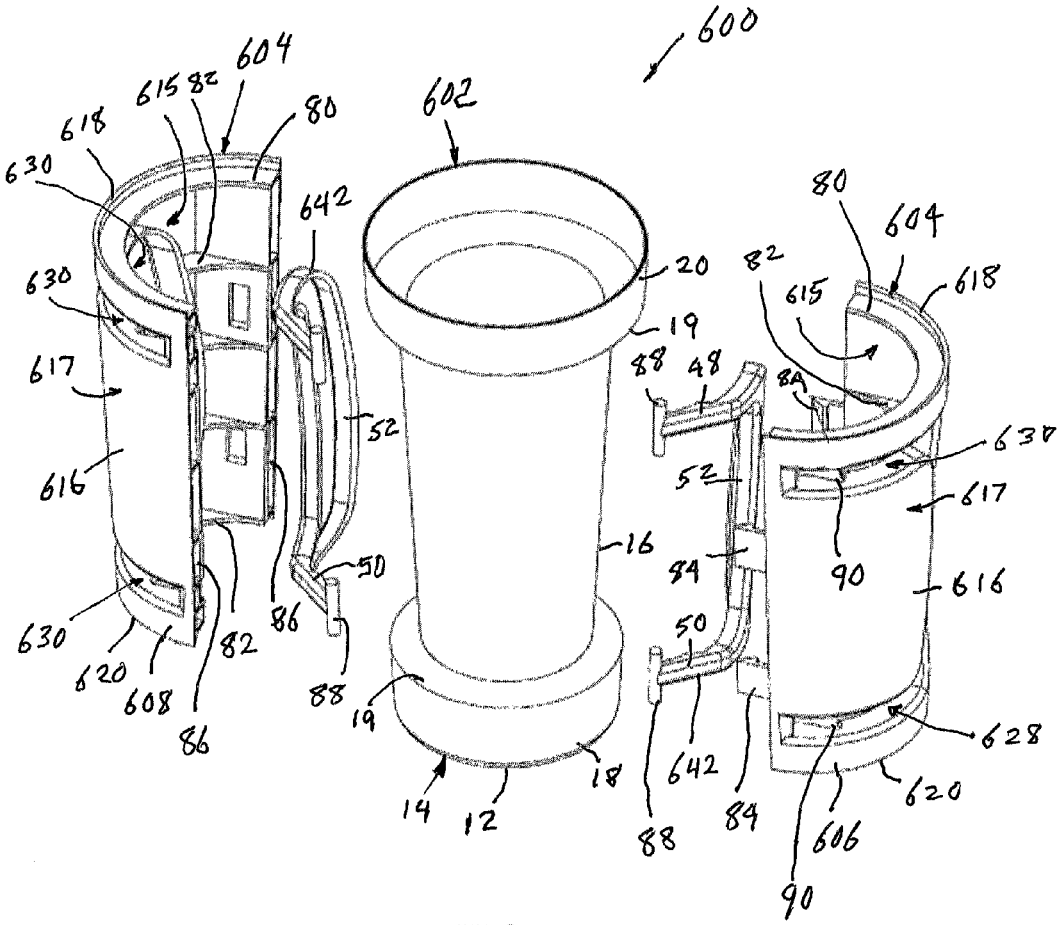
FIG. 27 is an exploded perspective view of a cup and cup holder, the cup holder being bifurcated, and two handles with rod portions trapped between the cup holder and cup when the bifurcated holder is joined together.

A combined cup and cup holder 600 is shown in FIG. 27 to have a cup 602 and a bifurcated cup holder 604 including a pair of handles 642. The cup 602 can have a base 12 having an essentially planar bottom 14. The cup 602 can be formed of plastic, metal, glass and other materials, and may be a disposable, single use item or one intended for multiple uses. An outer sidewall 16 can extend upward from the base 12. The outer sidewall 16 can include a lower margin 18 that is continuously joined to the base 12, and an upper margin 20. While the upper and lower margins 18 and 20 of outer sidewall 16 are shown to be circular, so that the sidewall is generally cylindrical, other shapes are also possible. At least one step 19 can be provided between the upper and lower margins 18 and 20 to further define the outer sidewall 16 into a smaller central diameter and larger upper and lower diameters.

Figure 27A:
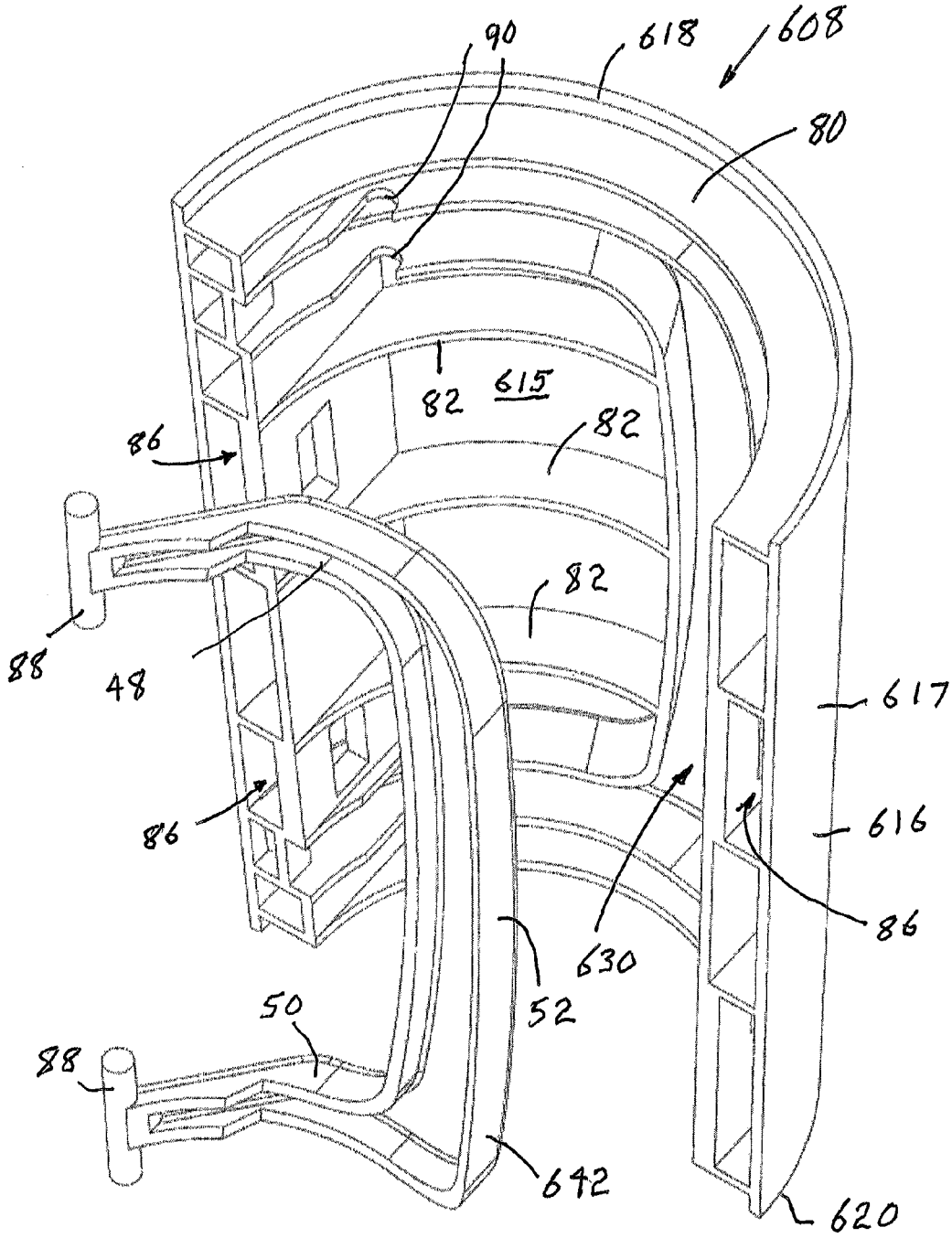
FIG. 27A is a perspective view of the interior of one half of the bifurcated cup holder shown in FIG. 27, and one of the handles.

The bifurcated cup holder 604, shown in FIGS. 27 and 27A, can have a first portion 606 and a second portion 608. Each of the portions 606, 608 can include a sidewall 616 having an inner surface 615, an outer surface 617, an upper margin 618, and a lower margin 620. Each of the portions 606, 608 can also include a recess 628, 630, respectively opening through the sidewall 616 designed to receive one of the pair of handles 642. Each of the portions 606, 608 can also include a web 80 projecting inwardly from the inner surface 615 to engage the step 19 adjacent to the upper margin 18 of the cup 602. Additional webs 82 can be provided that project inwardly from the inner surface 615 to engage the outer sidewall 16 of the cup 602. A number of tabs 84 can be provided on at least one of the first and second portions 606 and 608. A corresponding number of nooks 86 can be provided on at least one of the first and second portions 606 and 608 to receive the tabs 84 when the portions 606 and 608 of the bifurcated cup holder 604 are joined together.

Each of the handles 642 can be suitably dimensioned to be received wholly within the pair of recesses 628, 630 in the sidewall 616 of bifurcated cup holder 604. Each handle 642 can each include an upper portion 48, a lower portion 50, and a middle portion 52 that can join the upper and lower portions into a one-piece unitary formation. T-shaped ends 88 can be provided on the upper and lower portions 48, 50. The T-shaped ends 88 can be received in sockets 90 that can be provided on the webs 82 projecting inwardly from the inner surface 615 of the first and second portions 606 and 608. The T-shaped ends 88 are further trapped in the sockets 90 by the outer sidewall 16 of cup 602 when the combined cup and cup holder 600 is assembled. The T-shaped ends 88 permit the handles 642 to be displaced from a recessed position to a projecting position so that the middle portions 52 of the handles 642 are sufficiently close to each other to permit the handles 642 to be grasped in one hand by a user of the combined cup and cup holder 600.

Figure 28:
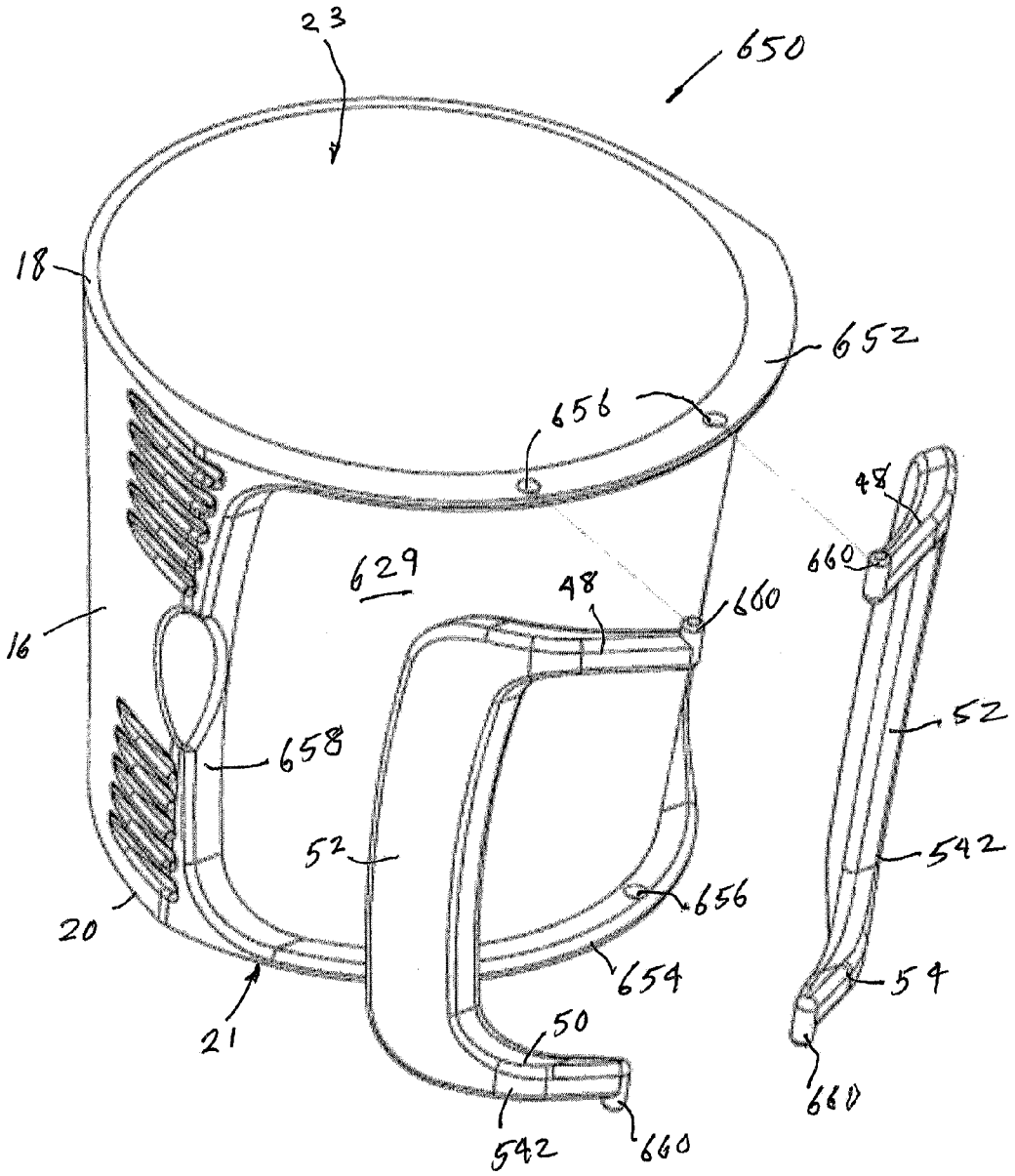
FIG. 28 is an exploded perspective view of a cup or cup holder having outwardly extending flanges having openings, and handles including bosses designed to be received in the flange openings.

Another cup holder 650 is shown in FIG. 28 to include an outer sidewall 16 that can have an upper margin 18 and a lower margin 20. A base can, optionally, be provided having an essentially planar bottom joining the lower margin 20. Alternatively, the lower margin 20 can define a lower opening 21 designed to receive the lower end portion of a cup, not shown, which may or may not be disposable. The upper margin 18 can define an upper opening 23 into the interior of the cup holder 650. The cup holder 650 can be formed of plastic, metal, glass and other materials. While the upper and lower margins 18 and 20 of outer sidewall 16 are shown to be circular, so that the sidewall is generally cylindrical, other shapes are also possible. The sidewall 16 can be made of a single layer of material or multiple layers of material to enhance the thermal retention properties of the cup holder 650. The cup holder 650 can have upper and lower flanges 652 and 654 that project outward respectively from the upper and lower margins 18, 20. The upper and lower flanges 652, 654 can each have openings 656. Side margins 658 can be provided between the upper and lower flanges 652 and 654 to define a single recess 629 in the sidewall 16 of the cup holder 650.

Handles 542 are suitable for use in conjunction with the cup holder 650. The pair of handles 542 can be suitably dimensioned to be received wholly within the recess 629 in the sidewall 16 of the cup holder 650. Each handle 542 can each include an upper portion 48, a lower portion 50, and a middle portion 52 that can join the upper and lower portions into a one-piece unitary formation. A boss 660 can project extend vertically upward from the upper portion 48 and vertically downward from the lower portion 50. The bosses 660 can be received in the openings 656 of the upper and lower flanges 652 and 654 of the cup holder 650 so that the handles 542 can be wholly received within the recess 629. The bosses 660 can be rotated in the openings 656 to permit the handles 542 to be displaced from a recessed position wholly within the recess 629 to a projecting position so that the middle portions 52 of the handles 542 are sufficiently close to each other to permit the handles 542 to be grasped in one hand by a user of the cup holder 650.

While these features have been disclosed in connection with the illustrated preferred embodiments, other embodiments of the invention that come within the spirit of the invention as defined in the following claims will be apparent to those skilled in the art.

The invention claimed is:

1. A cup holder comprising:

a sidewall having an inner surface and an outer surface, an upper margin of the sidewall surrounding an opening into an interior, the sidewall including a pair of recesses situated on opposite sides of a vertical midline, each of the recesses including at least one socket portion and a wedge-shaped slot extending from each of the at least one socket portions;

a pair of handle elements adapted to be received wholly within the pair of recesses in the sidewall, each of the handle elements including at least one socket engaging portion connected to the respective handle elements through a web portion sized to pass through the wedge-shaped slot, wherein the at least one socket engaging portion is received in the at least one socket portion of one of the recesses, the at least one socket engaging portion being pivotable within the at least one socket portions so as to permit the handle elements to be displaced from within the sidewall recesses to a position projecting outward from the sidewall sufficiently to permit the pair of handle elements to be grasped in one hand; and a shoulder continuously joined to the upper margin of the sidewall and extending from the sidewall to a finish, the finish being adapted to receive a closure.

2. The cup holder of claim 1, wherein the at least one socket portion comprises upper and lower sockets situated at upper and lower ends of the recess portions.

3. The cup holder of claim 2, wherein each of the pair of handle elements comprise upper and lower ball portions received in the upper and lower sockets situated at upper and lower ends of the recess portions.

4. The cup holder of claim 3, wherein at least one of the upper and lower ball portions is non-spherical so as to provide a detent biasing the handle elements toward a fully retained or a fully projecting position.

5. The cup holder of claim 1, wherein the vertical midline is arranged parallel to an axis of the cup holder.

6. The cup holder of claim 1, wherein the finish is threaded to receive the closure.

7. A cup holder comprising:

a sidewall having an inner surface and an outer surface, an upper margin of the sidewall surrounding an opening into an interior, the sidewall including a pair of recesses situated on opposite sides of a vertical midline, each of the recesses including at least one socket portion and a wedge-shaped slot extending from each of the at least one socket portions;

a pair of handle elements adapted to be received wholly within the pair of recesses in the sidewall, each of the handle elements including at least one socket engaging portion connected to the respective handle elements through a web portion sized to pass through the wedge-shaped slot, wherein the at least one socket engaging portion is received in the at least one socket portion of one of the recesses, the at least one socket engaging portion being pivotable within the at least one socket portions so as to permit the handle elements to be displaced from within the sidewall recesses to a position projecting outward from the sidewall sufficiently to permit the pair of handle elements to be grasped in one hand; and a step arranged between a base and the upper margin which defines the shape of the sidewall as having a first region extending from the base and a second region extending from the upper margin, a diameter of the first region being smaller than a diameter of the second region.

8. A cup holder comprising:

a container having a base, a sidewall extending from the base, an upper margin of the sidewall defining an opening into an interior of the container having a prescribed volume;

a shell comprising a first portion and a second portion configured to be joined together to encircle the sidewall of the container, each of the first portion and the second portion of the shell having an inner surface, an outer surface, a recess defining an opening from the inner surface to the outer surface, and at least one gap formed on the inner surface, wherein the at least one gap defines at least one socket region formed in the recess; and at least one handle element adapted to be received within the recess of each of the first portion and the second portion; the at least one handle element including at least one protruded end; the at least one protruded end being pivotable within the at least one socket region so as to permit part of the at least one handle element to be displaced outside the recess to a position projecting outward from the shell.

9. The cup holder of claim 8, wherein the inner surface of the first portion and the second portion of the shell further comprises a web projecting from the inner surface of the shell to engage the sidewall of the container.

10. The cup holder of claim 9, wherein the sidewall of the container further comprises a step configured so that the web of the shell engages the sidewall of the container substantially vertically and substantially horizontally.

11. The cup holder of claim 9, wherein the at least one gap which defines the socket region is formed by the web of the inner surface of the shell.

12. The cup holder of claim 8, wherein the at least one protruded end of the handle element is T-shaped.

13. The cup holder of claim 8, wherein each of the first portion and the second portion of the shell further comprises at least one tab and a corresponding number of nooks on at least one of the first portion and the second portion, wherein each of the nooks are configured to receive a respective one of the at least one tabs when the first portion and the second portion of the shell are joined together.

14. The container of claim 8, wherein the at least one socket region comprises upper and lower sockets situated at upper and lower ends of the recess.

15. A cup holder comprising:

a base, a sidewall extending from the base, the sidewall having an upper margin and a lower margin, each defining openings into an interior of the cup holder, and each of the upper and lower margins including an upper flange and a lower flange projecting outward from the respective upper and lower margins, a pair of side margins arranged between the upper flange and the lower flange to define a single recess in the sidewall, and at least one slot in at least one of the upper flange and the lower flange; and a pair of handle elements adapted to be received within the recess in the sidewall, each of the handle elements including at least one boss portion configured to be received in the at least one slot, the at least one boss portion being pivotable within the at least one slot so as to permit relocation of part of the pair of handle elements from the recess to a position projecting outward from the sidewall.

16. The cup holder of claim 15, wherein the sidewall is formed of a single layer of material.

17. The cup holder of claim 15, wherein the sidewall is formed of multiple layers of material.

18. The cup holder of claim 17, wherein the single recess is present in an outermost layer of the multiple layers of material.

19. The cup holder of claim 15, wherein at least one of the boss portions of each handle element further comprises a projecting portion adapted to engage with the slot so as to provide a detent biasing each handle toward either receipt and retention within the recess or a projecting position.

20. The container of claim 15, wherein the pair of handle elements are adapted to be displaced from within the single recess to a position projecting outward from the sidewall sufficiently to permit the middle portions of the pair of handle elements to contact each other.

* * * * *